US006837224B2

(12) United States Patent
Kidokoro et al.

(10) Patent No.: US 6,837,224 B2
(45) Date of Patent: Jan. 4, 2005

(54) EVAPORATED FUEL TREATMENT DEVICE FOR INTERNAL COMBUSTION ENGINE

(75) Inventors: Toru Kidokoro, Torrance, CA (US); Takuji Matsubara, Yokosuka (JP); Yoshihiko Hyodo, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/700,827

(22) Filed: Nov. 5, 2003

(65) Prior Publication Data

US 2004/0089064 A1 May 13, 2004

(30) Foreign Application Priority Data

Nov. 5, 2002 (JP) ..... 2002-321658

(51) Int. Cl.[7] ..... F02M 37/00
(52) U.S. Cl. ..... 123/520
(58) Field of Search ..... 123/516–520, 123/198 D

(56) References Cited

U.S. PATENT DOCUMENTS 5,911,209 A * 6/1999 Kouda et al. ..... 123/520
6,213,102 B1 * 4/2001 Isobe et al. ..... 123/520
6,223,732 B1 * 5/2001 Isobe et al. ..... 123/520
6,247,458 B1 * 6/2001 Heinemann et al. ..... 123/520
6,435,164 B1 * 8/2002 Kaiser et al. ..... 123/516

FOREIGN PATENT DOCUMENTS

JP 2001-294052 10/2001

* cited by examiner

*Primary Examiner*—Thomas Moulis
(74) *Attorney, Agent, or Firm*—Kenyon & Kenyon

(57) ABSTRACT

A sealing valve is installed between a fuel tank and a canister. A purge VSV is installed between the canister and an intake path. A pump module unit is installed to introduce a negative pressure into the canister. The negative pressure is introduced into the canister while the purge VSV and sealing valve are closed. An open failure diagnostic check is conducted on the sealing valve in accordance with the prevalent canister side pressure. A close failure diagnostic check is conducted on the sealing valve by making use of a differential pressure that is generated across the sealing valve as a result of the open failure diagnostic check.

5 Claims, 17 Drawing Sheets

(A)

(B)

(A)

(B)

ECU POWER SUPPLY SHUTOFF JUDGEMENT

EVAPORATED FUEL TREATMENT DEVICE FOR INTERNAL COMBUSTION ENGINE

BACKGROUND OF THE INVENTION

1. Field of the Invention

The present invention relates to an evaporated fuel treatment device, and more particularly to an evaporated fuel treatment device for treating evaporated fuel generated in a fuel tank without emitting it to the atmosphere.

2. Background Art

A conventional evaporated fuel treatment device disclosed, for instance, by JP-A No. 2001-294052 is equipped with a canister that communicates with a fuel tank. This device is also equipped with a sealing valve that is positioned in path between the fuel tank and canister. The sealing valve opens for refueling and in other situations where evaporated fuel should be allowed to escape from the fuel tank. In such an instance, the canister absorbs the evaporated fuel escaping from the fuel tank. When predefined purge conditions are established, the evaporated fuel absorbed by the canister is purged into an internal-combustion engine's intake path. As a result, the evaporated fuel generated in the fuel tank is treated as fuel without being emitted to the atmosphere.

The above conventional device is capable of checking for leakage in the device by the method described below. After internal-combustion engine startup, the device first detects the tank internal pressure while the sealing valve is closed. If the detected tank internal pressure is close to the atmospheric pressure, the device opens the sealing valve to conduct a leak check on the whole line containing both the fuel tank and canister. If, on the other hand, the tank internal pressure detected with the sealing valve closed is a predetermined positive pressure or negative pressure, the device immediately makes a judgment that no leakage is in the fuel tank. Then, a check is made for determining whether leakage is in the line on the canister side with the sealing valve left closed. The use of the above method makes it possible to detect leakage in the device accurately and promptly after internal-combustion engine startup.

However, the above conventional device does not take sealing valve failure diagnostics into consideration. If an open failure occurs in the sealing valve, a desired evaporated fuel treatment capacity may not be obtained due to an improperly closed fuel tank. If a close failure occurs in the sealing valve, a desired refueling characteristic may not be obtained. Therefore, when the employed system is equipped with a sealing valve that hermetically closes the fuel tank, it is desirable that a failure diagnostic check be accurately conducted on the sealing valve.

SUMMARY OF THE INVENTION

The present invention is made to solve the above problem, and has for its object to provide an evaporated fuel treatment device having a capability for conducting an efficient, accurate failure diagnostic check on a sealing valve that hermetically closes a fuel tank.

The above object of the present invention is achieved by an evaporated fuel treatment device for internal combustion engine that uses a canister to absorb evaporated fuel generated in a fuel tank for evaporated fuel treatment purposes. The device includes a sealing valve for controlling the continuity between the fuel tank and the canister. A purge control valve is provided for controlling the continuity of a purge path for communication between the canister and the internal combustion engine. The device also includes a differential pressure generation unit for producing a pressure differential between the inside and the outside of the canister. A leak check unit is provided for activating the differential pressure generation unit while the purge control valve is closed, and conducting a system leak check in accordance with a resulting pressure generated within a hermetically closed space containing the canister or within a hermetically closed space containing the fuel tank. A sealing valve diagnostic unit is also provided for conducting a failure diagnostic check on the sealing valve simultaneously with the execution of processing for the leak check. The sealing valve diagnostic unit includes an open failure diagnostic unit for activating the differential pressure generation unit while the purge control valve and the sealing valve are closed, and conducting an open failure diagnostic check on the sealing valve in accordance with a resulting pressure generated within a hermetically closed space containing the canister or within a hermetically closed space containing the fuel tank. The sealing valve diagnostic unit further includes a close failure diagnostic unit for conducting a close failure diagnostic check on the sealing valve in accordance with a differential pressure that is generated between both sides of the sealing valve upon the open failure diagnostic check.

Other objects and further features of the present invention will be apparent from the following detailed description when read in conjunction with the accompanying drawings.

BEST MODE OF CARRYING OUT THE INVENTION

Figure 1:
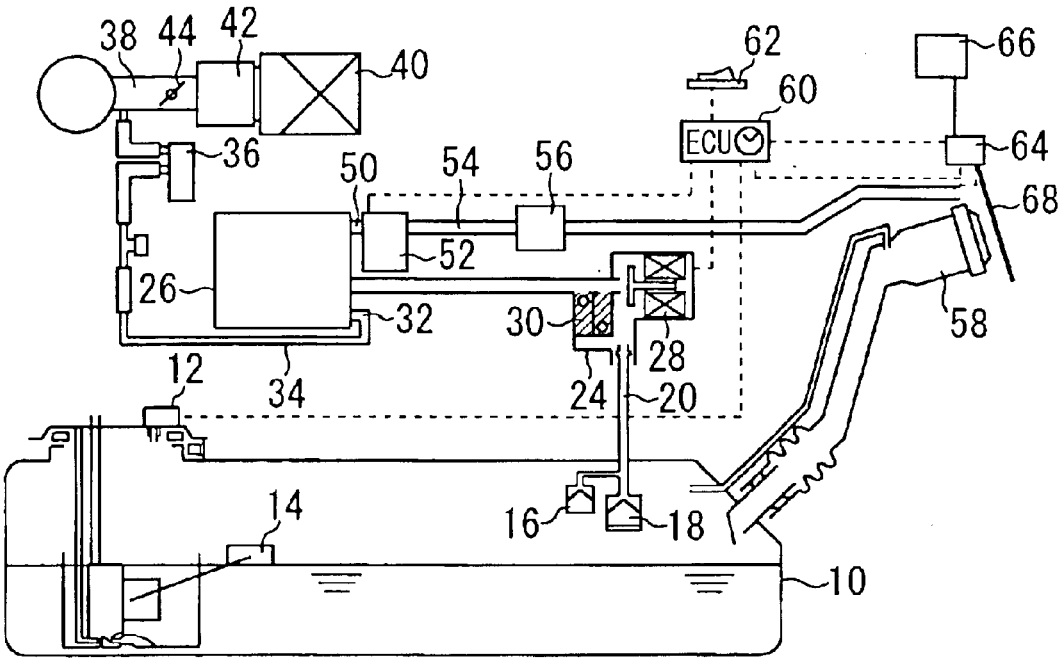
FIGS. 1A and 1B are drawings for describing a structure of an evaporated fuel treatment device according to a first embodiment of the invention.
Figure 1:
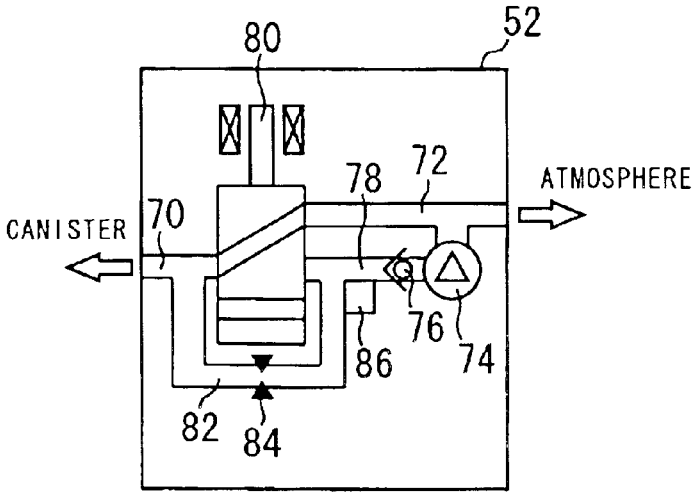
Figure 2:
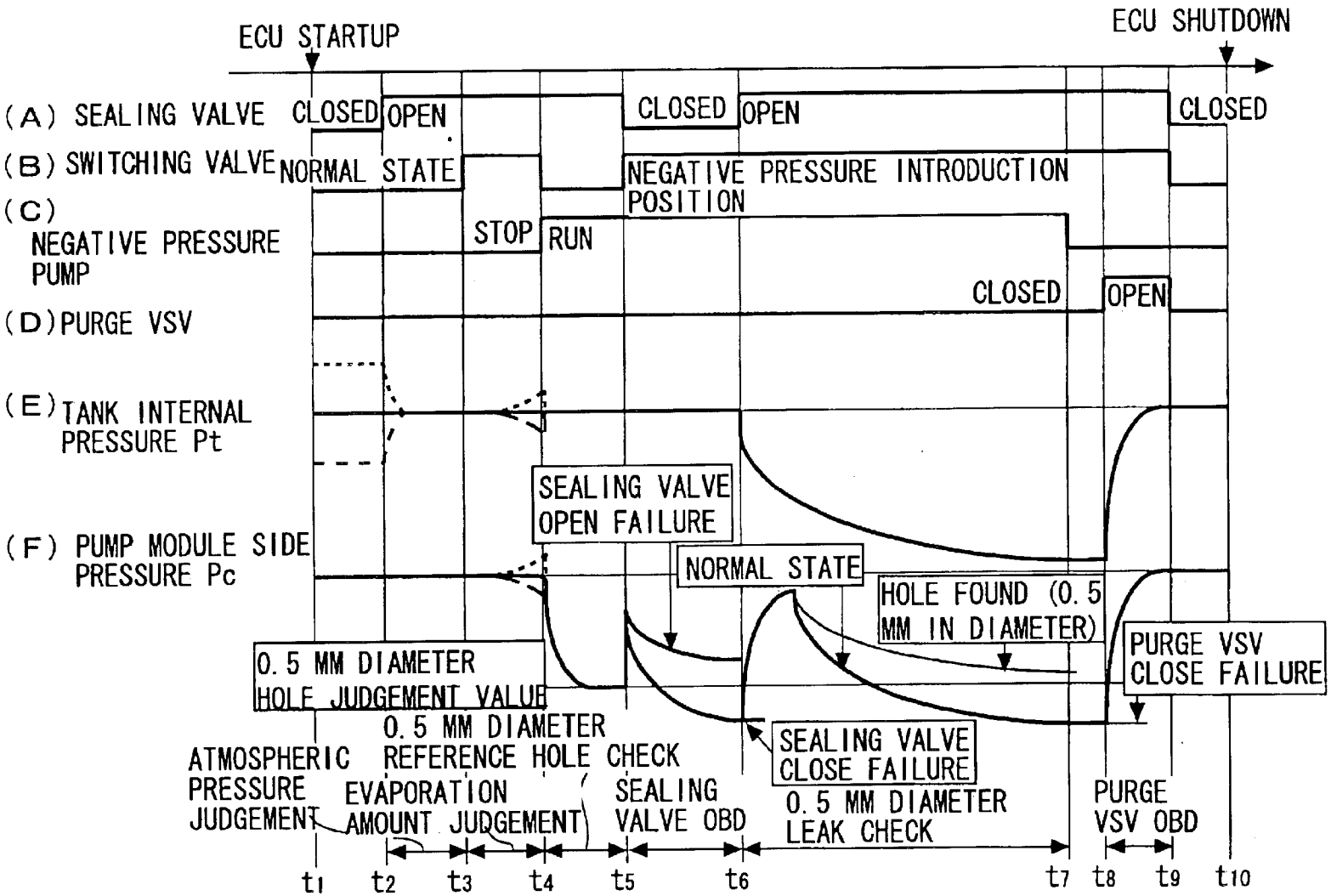
FIGS. 2A through 2F are timing diagrams illustrating abnormality detection process that is performed by the evaporated fuel treatment device according to the first embodiment.

Now, embodiments of the present invention will be described with reference to the drawings. Like reference numerals denote like components throughout the drawings, and redundant descriptions will be omitted.

First Embodiment

[Description of Structure of Device]

FIG. 1A illustrates a structure of an evaporated fuel treatment device according to a first embodiment of the invention. As shown in FIG. 1A, the device according to the present embodiment includes a fuel tank 10. The fuel tank 10 has a tank internal pressure sensor 12 for measuring tank internal pressure Pt. The tank internal pressure sensor 12 detects the tank internal pressure Pt as relative pressure with respect to atmospheric pressure, and generates output in response to a detection value. A liquid level sensor 14 for detecting a liquid level of fuel is placed in the fuel tank 10.

A vapor passage 20 is connected to the fuel tank 10 via ROVs (Roll Over Valves) 16, 18. The vapor passage 20 has a sealing valve unit 24 on the way thereof, and communicates with a canister 26 at an end thereof. The sealing valve unit 24 has a sealing valve 28 and a pressure control valve 30. The sealing valve 28 is a solenoid valve of a normally closed type, which is closed in a nonenergized state, and opened by a driving signal being supplied from outside. The pressure control valve 30 is a mechanical two-way check valve constituted by a forward relief valve that is opened when pressure of the fuel tank 10 side is sufficiently higher than pressure of the canister 26 side, and a backward relief valve that is opened when the pressure of the canister 26 side is sufficiently higher than the pressure of the fuel tank 10 side. Valve opening pressure of the pressure control valve 30 is set to, for example, about 20 kPa in a forward direction, and about 15 kPa in a backward direction.

The canister 26 has a purge hole 32. A purge passage 34 communicates with the purge hole 32. The purge passage 34 has a purge VSV (Vacuum Switching Valve) 36, and communicates, at an end thereof, with an intake passage 38 of the internal combustion engine. An air filter 40, an airflow meter 42, a throttle valve 44, or the like are provide in the intake passage 38 of the internal combustion engine. The purge passage 34 communicates with the intake passage 38 downstream of the throttle valve 44.

The canister 26 is filled with activated carbon. The evaporated fuel having flown into the canister 26 through the vapor passage 20 is adsorbed by the activated carbon. The canister 26 has an atmosphere hole 50. An atmosphere passage 54 communicates with the atmosphere hole 50 via a negative pressure pump module 52. The atmosphere passage 54 has an air filter 56 on the way thereof. An end of the atmosphere passage 54 is opened to the atmosphere near a refueling port 58 of the fuel tank 10.

As shown in FIG. 1A, the evaporated fuel treatment device according to the present embodiment has an ECU 60. The ECU 60 includes a soak timer for counting an elapsed time during parking of a vehicle. A lid switch 62 and a lid opener opening/closing switch 64 are connected to the ECU 60 together with the tank internal pressure sensor 12, the sealing valve 28, and the negative pressure pump module 52. A lid manual opening/closing device 66 is connected to the lid opener opening/closing switch 64 using a wire.

The lid opener opening/closing switch 64 is a lock mechanism of a lid (lid of a body) 68 that covers the refueling port 58, and unlocks the lid 68 when a lid opening signal is supplied from the ECU 60, or when a predetermined opening operation is performed on the lid manual opening/closing device 66. The lid switch 62 connected to the ECU 60 is a switch for issuing an instruction to unlock the lid 68 to the ECU 60.

FIG. 1B is an enlarged view for illustrating details of the negative pressure pump module 52 shown in FIG. 1A. The negative pressure pump module 52 has a canister side passage 70 communicating with the atmosphere hole 50 of the canister 26, and an atmosphere side passage 72 communicating with the atmosphere. The atmosphere side passage 72 communicates with a pump passage 78 having a pump 74 and a check valve 76.

The negative pressure pump module 52 has a switching valve 80 and a bypass passage 82. The switching valve 80 makes communication between the canister side passage 70 and the atmosphere side passage 72 in the nonenergized state (OFF state), and makes communication between the canister side passage 70 and the pump passage 78 in a state where the driving signal is supplied from outside (ON state). The bypass passage 82, which has a reference orifice 84 with a 0.5 mm diameter on the way thereof, makes communication between the canister side passage 70 and the pump passage 78.

Further, a pump module pressure sensor 86 is incorporated into the negative pressure pump module 52. The pump module pressure sensor 86 can detect pressure in the pump passage 78 at a position between the switching valve 80 and the check valve 76.

[Description of Basic Operations]

Next, basic operations of the evaporated fuel treatment device according to the present embodiment will be described.

(1) During Parking

The evaporated fuel treatment device according to the present embodiment generally keeps the sealing valve 28 in a closed state during the parking of the vehicle. When the sealing valve 28 is closed, the fuel tank 10 is separated from the canister 26 as long as the pressure control valve 30 is closed. Thus, in the evaporated fuel treatment device according to the present embodiment, the canister 26 adsorbs no more evaporated fuel during the parking of the vehicle, as long as the tank internal pressure Pt is lower than the forward direction valve opening pressure (20 kPa) of the pressure control valve 30. Similarly, the fuel tank 10 sucks no air during the parking of the vehicle, as long as the tank internal pressure Pt is higher than backward direction valve opening pressure (−15 kPa).

(2) During Refueling

In the device according to the present embodiment, when the lid switch 62 is operated during the parking of the vehicle, the ECU 60 is first activated to open the sealing valve 28. At this time, if the tank internal pressure Pt is higher than the atmospheric pressure, the evaporated fuel in the fuel tank 10 flows into the canister 26 at the same time as the sealing valve 28 is opened, and is adsorbed by the activated carbon therein. Thus, the tank internal pressure Pt is reduced near the atmospheric pressure.

When the tank internal pressure Pt is reduced near the atmospheric pressure, the ECU 60 issues an instruction to unlock the lid 68 to the lid opener 64. Receiving the instruction, the lid opener 64 unlocks the lid 68. This allows an opening operation of the lid 68 after the tank internal pressure Pt reaches near the atmospheric pressure, in the device according to the present embodiment.

After allowance of the opening operation of the lid 68, the lid 68 is opened, a tank cap is opened, and then refueling is started. The tank internal pressure Pt is reduced near the atmospheric pressure before the tank cap is opened, thus the opening operation does not cause the evaporated fuel to be released from the refueling port 58 into the atmosphere.

The ECU 60 keeps the sealing valve 28 in an opened state until the refueling is finished (concretely, until the lid 68 is closed). Thus, a gas in the tank can flow into the canister 26 through the vapor passage 20 during the refueling, thereby ensuring good refueling properties. At this time, the flowing evaporated fuel is not released into the atmosphere because being adsorbed by the canister 26.

(3) During Running

During running of the vehicle, control to purge the evaporated fuel adsorbed by the canister 26 is performed when a predetermined purge condition is satisfied. Concretely, in this control, the purge VSV 36 is appropriately subjected to duty driving, with the switching valve 80 being in OFF state and with the atmosphere hole 50 of the canister 26 being opened to the atmosphere. When the purge VSV 36 is subjected to the duty driving, induction negative pressure of the internal combustion engine is introduced into the purge hole 32 of the canister 26. Thus, the evaporated fuel in the canister 26 is purged into the intake passage 38 of the internal combustion engine, together with air sucked from the atmosphere hole 50.

During the running of the vehicle, the sealing valve 28 is appropriately opened so that the tank internal pressure Pt is kept near the atmospheric pressure, in order to reduce decompression time before the refueling. It should be noted that the opening of the valve is performed only during the purging of the evaporated fuel, that is, while the induction negative pressure is introduced into the purge hole 32 of the canister 26. In a state where the induction negative pressure is introduced into the purge hole 32, the evaporated fuel flowing out of the fuel tank 10 and into the canister 26 flows through the purge hole 32 without entering deeply inside the canister 26, and is then sucked into the intake passage 38. Thus, according to the device of the present embodiment, the canister 26 does not further adsorb a large amount of evaporated fuel during the running of the vehicle.

As described above, according to the evaporated fuel treatment device of the present embodiment, it is generally possible to limit the evaporated fuel adsorbed by the canister 26 only to the evaporated fuel flowing out of the fuel tank 10 during the refueling. Thus, the device according to the present embodiment allows reduction in size of the canister 26, and achieves satisfactory exhaust emission properties and good refueling properties.

[Description of an Abnormality Detection Operation]

The evaporated fuel treatment device is required to have a function for promptly detecting leaks in the lines, an abnormality of the sealing valve 28, and other abnormalities that may result in emission characteristics deterioration. The abnormality detection process to be performed by the evaporated fuel treatment device according to the present embodiment for the purpose of implementing the above function will now be described with reference to FIGS. 2A through 2F.

FIGS. 2A through 2F are timing diagrams illustrating the abnormality detection process that is performed by the evaporated fuel treatment device according to the present embodiment. For the purpose of minimizing the influence of various disturbances, the abnormality detection process according to the present embodiment is performed while the vehicle is parked.

As described earlier, the ECU 60 has a built-in soak timer. When the soak timer counts up to a predetermined time (e.g., five hours), the ECU starts up as shown in FIG. 2A in order to initiate the abnormality detection process (time t1). The evaporated fuel treatment device according to the present embodiment basically keeps the sealing valve 28 closed while the vehicle is parked. Therefore, when the ECU 60 starts up, the tank internal pressure Pt is usually a positive or negative pressure as indicated by a broken line in FIG. 2E.

When the ECU 60 starts up, the sealing valve 28 first switches from a closed state to an open state as indicated in FIG. 2A (time t2). When the sealing valve 28 opens, the interior of the fuel tank 10 is exposed to the atmosphere. Therefore, the tank internal pressure Pt subsequently changes to a value close to that of the atmospheric pressure as indicated in FIG. 2E.

At time t2, the evaporated fuel treatment device according to the present embodiment turns OFF both the pump 74 and switching valve 80 of the negative pressure pump module 52. In this instance, the atmospheric pressure is applied to the interior of the pump passage 78 so that the output of the pump module pressure sensor 86 is equivalent to the atmospheric pressure.

After the sealing valve 28 is opened at time t2, the output values of the tank internal pressure sensor 12 and pump module pressure sensor 86 are both equivalent to the atmospheric pressure. Therefore, the ECU 60 recognizes these sensor output values as a value equivalent to the atmospheric pressure, and then performs a calibration process for the tank internal pressure sensor 12 and pump module pressure sensor 86 in accordance with the values equivalent to the atmospheric pressure. In the present embodiment, this calibration process is referred to as an "atmospheric pressure judgment process."

After completion of the atmospheric pressure judgment process, the switching valve 80 switches from the OFF state to the ON state (time t3) as indicated in FIG. 2B. Since the purge VSV 36 is closed at this stage, the line containing the canister 26 and fuel tank 10 becomes a hermetically closed space when the switching valve 80 turns ON. In this instance, the outputs of the tank internal pressure sensor 12 and pump module pressure sensor 86 both exhibit changes depending on how the evaporated fuel is generated or liquefied in the fuel tank 10 (see broken lines in FIGS. 2E and 2F).

Therefore, the ECU 60, which turned ON the switching valve at time t3, examines the output of the tank internal pressure sensor 12 or pump module pressure sensor 86 to estimate how the evaporated fuel is generated (or liquefied) in the fuel tank 10. In the subsequent description of the present embodiment, this estimation process is referred to as an "evaporation amount judgment process."

After completion of the evaporation amount judgment process, the switching valve 80 switches back to the OFF state from the ON state as indicated in FIG. 2B and, at the same time, the pump 76 turns ON as indicated in FIG. 2C (time t4). When the switching valve 80 reverts to the OFF state, the intake port of the pump 74 communicates with the atmosphere via the check valve 76 and reference orifice 84. In this situation, therefore, the output of the pump module pressure sensor 86 converges to a value (negative pressure value) equivalent to a value that is output when the pump 74 operates in a state where a reference hole of 0.5 mm is bored in piping.

After time t4, the ECU 60 waits, as indicated in FIG. 2F, until the output Pc of the pump module sensor 86 (hereinafter referred to as the "canister side pressure Pc") converges to an appropriate value, and then memorizes the value reached upon convergence as a 0.5 mm diameter hole judgment value. From now on, the 0.5 mm diameter hole judgment value is used as the value for determining whether the evaporated fuel treatment device has a leak greater than the 0.5 mm diameter reference hole. In the subsequent description of the present embodiment, the above process for detecting the 0.5 mm diameter hole judgment value is referred to as a "0.5 mm diameter reference hole check process."

After completion of the 0.5 mm diameter reference hole check process, the sealing valve 28 switches from the open state to the closed state as indicated in FIG. 2A and, at the same time, the switching valve 80 switches from the OFF state to the ON state as indicated in FIG. 2B (time t5). When the switching valve 80 turns ON, the canister 26 is separated from the atmosphere to communicate with the intake port of the pump 74. As a result, the internal pressure of the canister 26 decreases so that the canister side pressure Pc gradually turns negative.

If the sealing valve 28 is properly closed, the negative pressure produced upon operation of the pump 74 is introduced into the canister 26 only. In this instance, therefore, the canister side pressure Pc suddenly changes after time t5. If, on the other hand, the sealing valve 28 is not properly closed, the negative pressure produced upon operation of the pump 74 is introduced not only into the canister 26 but also into the fuel tank 10. Therefore, the canister side pressure Pc tends to gradually decrease after time t5 (see FIG. 2F).

If the canister side pressure Pc rapidly decreases after time t5, the ECU 60 concludes that the sealing valve 28 is properly closed. However, if the canister side pressure Pc gradually decreases, the ECU 60 finds that the sealing valve 28 is not properly closed, that is, concludes that an open failure has occurred in the sealing valve 28.

When the open failure diagnostic check is completed for the sealing valve 28 (time t6), an adequately high negative pressure is stored in a hermetically closed space containing the canister 26 (a space enclosed by the negative pressure pump module 52, purge VSV 36, and sealing valve 28). After time t6, the ECU 60 uses such a negative pressure to conduct a close failure diagnostic check on the sealing valve 28.

More specifically, the ECU 60 issues a valve open instruction to the sealing valve 28 after time t6 as indicated FIG. 2A. When the sealing valve 28 properly switches from the closed state to the open state upon receipt of the instruction, the gas within the fuel tank 10 flows into the canister 26 through the sealing valve 28. The canister side pressure Pc then builds up to a great value immediately. If, on the other hand, the sealing valve does not properly open, no significant change occurs in the canister side pressure Pc (see FIG. 2F).

If an adequate change is found in the canister pressure Pc in synchronism with the valve open instruction issued at time t6, the ECU 60 concludes that the sealing valve 28 has properly switched from the closed state to the open state. However, if no such change is found in the canister side pressure Pc, the ECU 60 judges that the sealing valve 28 does not properly open, that is, concludes that a close failure has occurred in the sealing valve 28.

As described above, the evaporated fuel treatment device according to the present embodiment can judge whether the canister side pressure Pc rapidly decreases after time t5 for the purpose of determining whether an open failure has occurred in the sealing valve 28. After time t6, the evaporated fuel treatment device according to the present embodiment can also efficiently judge whether a close failure has occurred in the sealing valve 28 by making use of a negative pressure that is stored in the canister 26 during the open failure diagnostic check sequence for the sealing valve 28. In the subsequent description of the present embodiment, the above judgment process is referred to as a "sealing valve OBD process."

When the sealing valve 28 properly opens at time t6, a hermetically closed space including the canister 26 and fuel tank 10 is formed at the time point. A certain negative pressure is stored in the hermetically closed space containing the canister 26 and fuel tank 10 at the time when the close failure diagnostic check for the sealing valve 28 is terminated. After the above-mentioned sealing valve OBD process is terminated, the ECU 60 attempts to raise the negative pressure within the hermetically closed space while effectively using the negative pressure, and conducts a system leak check by determining whether the canister side pressure Pc converges to a value smaller than the 0.5 mm diameter hole judgment value during the attempt for negative pressure increase.

If there are no leaks in the canister 26 or fuel tank 10, both the canister side pressure Pc and the tank internal pressure Pt converge to a value smaller than the 0.5 mm diameter hole judgment value after the sealing valve 28 is opened to unify the canister 26 and fuel tank 10 in a hermetically closed space. However, if there is any leak in either or both the canister 26 and fuel tank 10, neither the value Pc nor the value Pt decreases to the 0.5 mm diameter hole judgment value.

If the value Pc or Pt decreases lower than the 0.5 mm diameter hole judgment value before an appropriate amount of time elapses after time t6, the evaporated fuel treatment device according to the present embodiment can therefore conclude that there is no leak in the whole system. If, on the other hand, such a condition is not established, the evaporated fuel treatment device according to the present embodiment can conclude that there is a leak greater than the reference hole at some place within the system. In this instance, the above leak check can be started when the space containing the canister 26 and fuel tank 10 is placed under a certain degree of negative pressure as a result of sealing valve OBD process execution. Therefore, the evaporated fuel treatment device according to the present embodiment can efficiently conduct a system leak check. In the subsequent description of the present embodiment, the above judgment process is referred to as a "0.5 mm diameter leak check process."

Upon completion of the 0.5 mm diameter leak check process, the pump 74 turns OFF (time t7) as indicated in FIG. 2C. Then, after an appropriate amount of time elapses, the purge VSV 36 opens (time t8) as indicated in FIG. 2D. When this process causes the purge VSV 36 to properly open, the line containing the canister 26 and fuel tank 10 is no longer hermetically closed so that both the canister side pressure Pc and the tank internal pressure Pt tend to increase subsequently. However, if the purge VSV does not properly open, no significant change occurs in the value Pc or Pt (see FIGS. 2E and 2F).

Thus, the ECU 60 concludes that the purge VSV 36 has properly switched from the close state to the open state when a significant change is found in the canister side pressure Pc or the tank internal pressure Pt after time t8. If, on the other hand, no significant change is found in the pressure Pc or Pt, the ECU 60 finds that the purge VSV 36 does not properly open, that is, concludes that a close failure has occurred in the purge VSV 36. In the subsequent description of the present embodiment, the above judgment process is referred to as a "purge VSV OBD process."

Upon completion of the purge VSV OBD process, a series of abnormality detection processing steps terminates (time t9). The ECU 60 then turns OFF all mechanisms. As a result, the evaporated fuel treatment device reverts to a normal state, which is prevalent while the vehicle is parked, that is, the state prevalent before time t2. When an appropriate amount of time elapses subsequently, the ECU 60 comes to a stop (time t10).

As described above, the evaporated fuel treatment device according to the present embodiment can perform a failure detection process for the sealing valve 28, a leak detection process for the whole system, and a failure detection process for the purge VSV 36 sequentially and efficiently by performing the abnormality detection processing steps in compliance with the timing diagram shown in FIGS. 2A through 2F.

[Details of Processing Steps Performed by the ECU]

Figure 3:
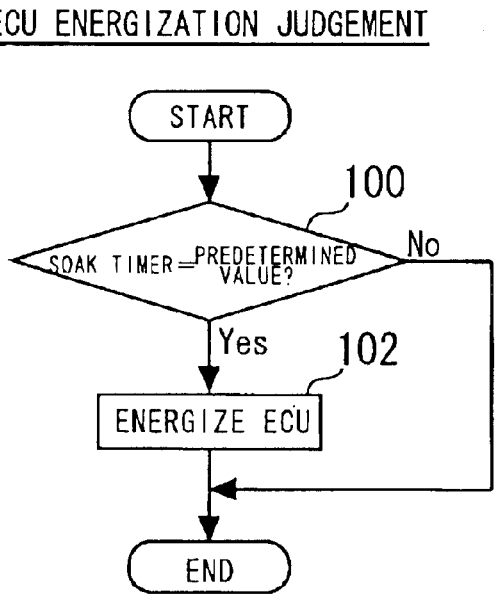
FIG. 3 is a flowchart illustrating an ECU energization judgment routine that is performed by the evaporated fuel treatment device according to the first embodiment.

The processing steps to be performed by the ECU 60 for implementing the abnormality detection process will now be described with reference to FIGS. 3 through 11. FIG. 3 is a flowchart illustrating an ECU energization judgment routine that the ECU 60 performs in order to determine the time for executing the abnormality detection process. As a precondition for execution of this routine, it is assumed that the ECU 60 starts counting in an ascending order with the soak timer when the vehicle settles down in a parked state.

When the vehicle settles down in the parked state, the ECU 60 starts counting in an ascending order with the soak timer and goes into a standby state in which only the routine shown in FIG. 3 can be executed. The routine shown in FIG. 3 is repeatedly started at predetermined time intervals while the vehicle is parked. This routine first checks whether the count reached by the soak timer coincides with a predetermined value (step 100). The condition for step 100 is established when, for instance, approximately five hours elapse after the vehicle settles down in the parked state.

If it is found that the condition for step 100 is not established, the current processing cycle promptly terminates. If the condition is established, on the other hand, an energization process is performed in order to fully operate the ECU 60 (step 102).

Figure 4:
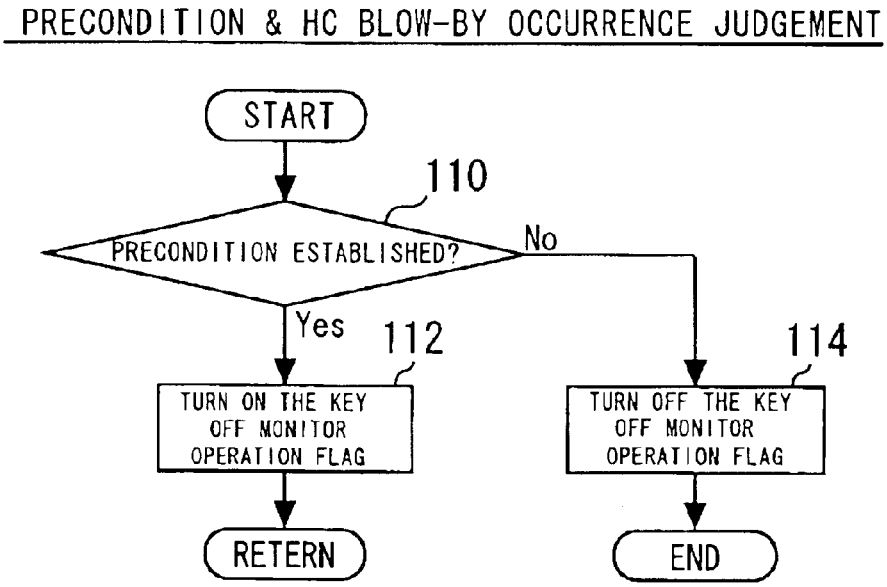
FIG. 4 is a flowchart illustrating a control routine that is executed to perform a KEY OFF monitor operation flag process by the evaporated fuel treatment device according to the first embodiment.

FIG. 4 is a flowchart illustrating a control routine that is executed by the ECU 60 to perform a KEY OFF monitor operation flag process after processing step 102 is performed as described above to energize the ECU 60. In the present embodiment, the KEY OFF monitor operation flag is used, as described later, to indicate whether power should be continuously applied to the ECU 60.

The routine shown in FIG. 4 first checks whether the precondition for evaporated fuel treatment device abnormality detection is established (step 110). As described earlier, the present embodiment performs the abnormality detection operation for the evaporated fuel treatment device while the vehicle is parked. Thus, it is confirmed that the ignition switch (IG switch) is OFF as the precondition. For the present embodiment, it is also necessary that the pump 74 be operated during the abnormality detection process. To this end, it is confirmed that the battery voltage is proper as the precondition. To avoid a judgment error, it is also desirable that the abnormality detection process be not performed in an extreme environment. Therefore, various checks are conducted as the precondition, for instance, to determine whether the previous trip drive record (the drive record made before settled down to the parked state) is extreme and whether the current intake air temperature and water temperature are extreme (extremely low).

If it is found in step 110 above that the precondition is established, a process is performed to turn ON the KEY OFF monitor operation flag (step 112). If, on the other hand, it is found in step 110 that the precondition is not established, the KEY OFF monitor operation flag turns OFF (step 114).

Figure 5:
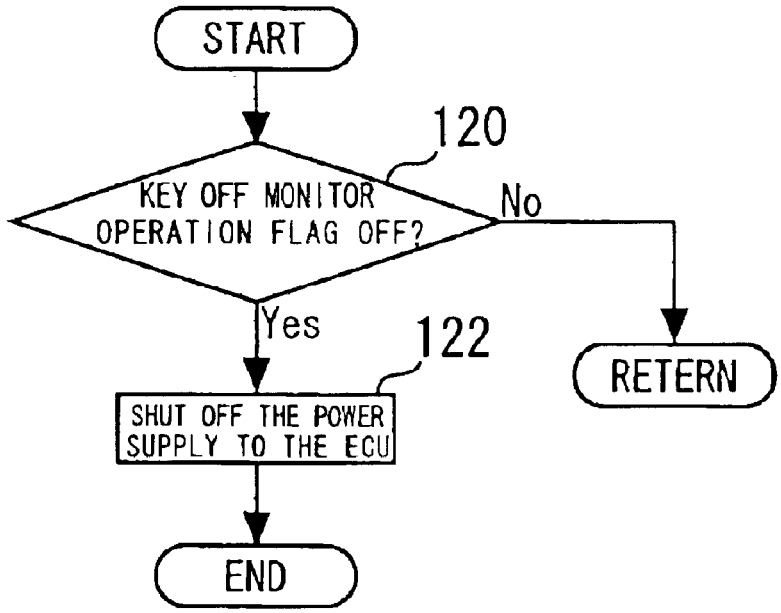
FIG. 5 is a flowchart illustrating a control routine that is executed to shut off the power supply to an ECU by the evaporated fuel treatment device according to the first embodiment.

FIG. 5 is a flowchart illustrating a control routine that is executed by the ECU 60 to shut off the power supply to the ECU 60 when the KEY OFF monitor operation flag turns OFF. The routine shown in FIG. 5 first checks whether the KEY OFF monitor operation flag is OFF (step 120).

If the routine finds that the KEY OFF monitor operation flag is not OFF, the current processing cycle terminates while the power supply to the ECU 60 is maintained. However, if it is found that the KEY OFF monitor operation flag is OFF, the routine shuts off the main power supply to the ECU 60 to put the ECU 60 on standby again (step 122), and then terminates.

The ECU 60 remains energized during the time interval between the instant at which step 102 above is performed to start an energization sequence and the instant at which the KEY OFF monitor operation flag turns OFF. The ECU 60 then executes, as far as it remains energized, the routines shown in FIGS. 6 to 11, which are described later, in order to continue with the abnormality detection process in a sequence indicated in FIG. 2.

Figure 6:
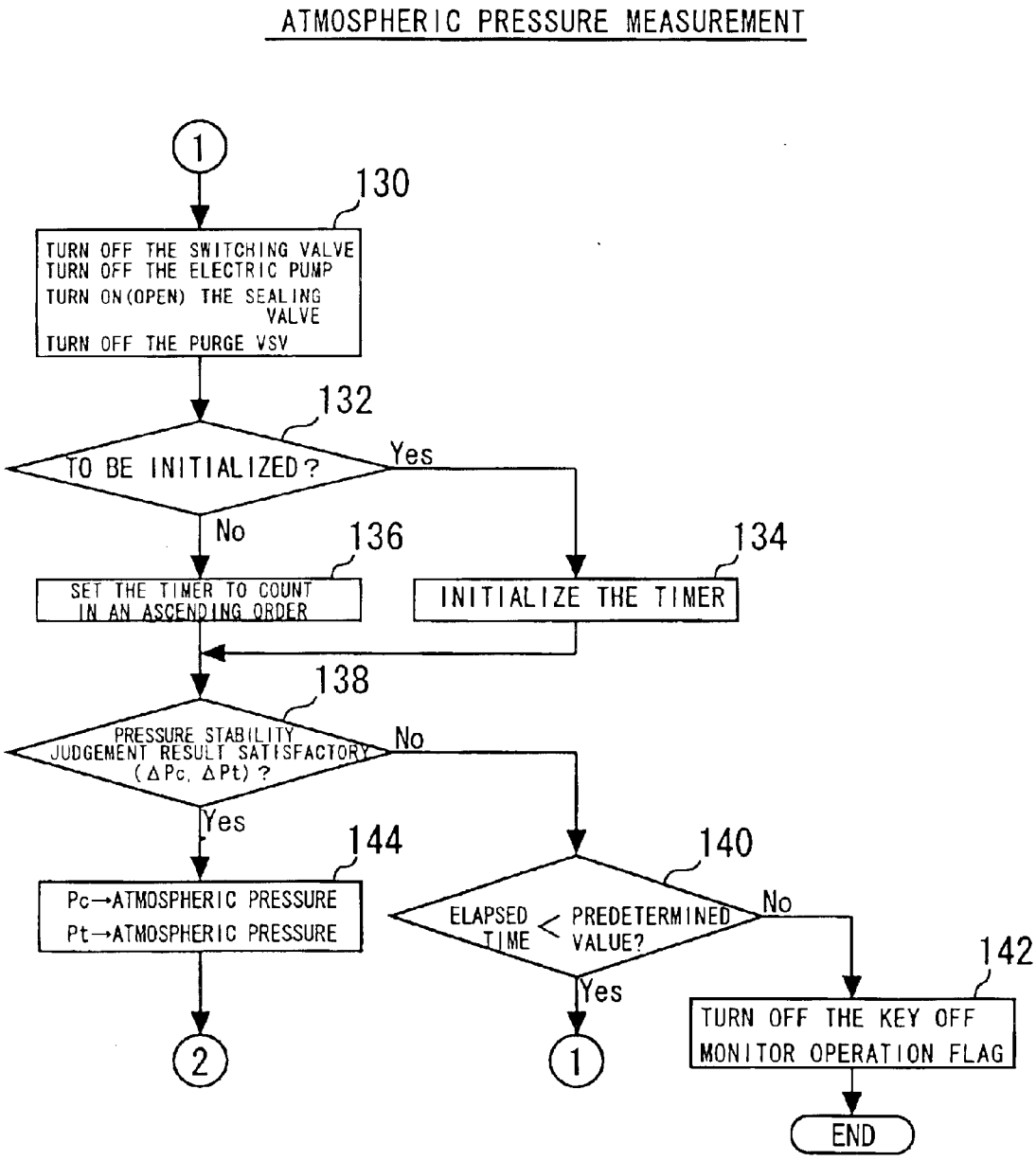
FIG. 6 is a flowchart illustrating a control routine that is executed to implement atmospheric pressure judgment process by the evaporated fuel treatment device according to the first embodiment.

FIG. 6 is a flowchart illustrating a control routine that is executed by the ECU 60 to implement an "atmospheric pressure judgment process." The routine shown in FIG. 6 first controls various elements of the evaporated fuel treatment device as indicated below to invoke a state prevalent at time t2 in FIGS. 2A through 2F, that is, to expose both the tank internal sensor 12 and pump module pressure sensor 86 to the atmosphere (step 130):

Switching valve 80: OFF

Pump 74: OFF

Sealing valve 28: ON (open)

Purge VSV 36: OFF

When the above process terminates, the routine continues to check whether the timer should be initialized (step 132). If step 132 is performed for the first time after energization of the ECU 60, the routine concludes that timer initialization should be effected. In this instance, the timer is initialized, as the next step, to reset its numerical value (step 134). If, on the other hand, step 132 was already performed during the time interval between the instant at which the ECU 60 began to become energized and the instant at which the current processing cycle started, the routine concludes that the timer need not be initialized. In this instance, the routine causes the timer to count up (step 136).

Next, the routine shown in FIG. 6 checks whether the tank internal pressure Pt and the canister side pressure Pc are stabilized. More specifically, the routine checks whether the amount of change ΔPt in the tank internal pressure Pt and the amount of change ΔPc in the canister side pressure Pc, which can be determined by checking their pressure value differences between the previous processing cycle and the current, are smaller than their respective predetermined judgment values (step 138).

If the result of the above check indicates that the pressures Pc and Pt are still not stabilized, the routine checks whether the elapsed time from the start of the routine, that is, the elapsed time measured by the timer, is shorter than a predetermined period of time (step 140).

If the result of the above check indicates that the elapse time is still shorter than the predetermined period of time, the routine repeats steps 130 and beyond. If, on the other hand, the elapsed time is already equal to or longer than the predetermined period of time, the routine concludes that the encountered situation is inappropriate for abnormality detection process continuation, and then turns OFF the KEY OFF monitor operation flag (step 142).

If the system is normal, the canister side pressure Pc and the tank internal pressure Pt both stabilize at a value corresponding to the atmospheric pressure before the elapsed time reaches the predetermined period of time. In this case, the condition prescribed for step 138 above is established when the pressures Pc and Pt stabilize. When the condition for step 138 is established, the routine shown in FIG. 6 memorizes the prevalent canister side pressure Pc as the output which the pump module pressure sensor 86 generates as correspondence of the atmospheric pressure, and memorizes the prevalent tank internal pressure Pt as the output which the tank internal pressure sensor 12 generates as representation of the atmospheric pressure (step 144).

After completing the "atmospheric pressure judgment process" in accordance with the routine shown in FIG. 6, the ECU 60 calibrates the output of the pump module pressure sensor 86 and the output of the tank internal pressure sensor by using the pressure values Pc and Pt, which were memorized in step 144 above. Although the execution of a calibration procedure is not described herein for the convenience of explanation, the subsequent description assumes that the canister side pressure Pc and the tank internal pressure Pt represent their respective calibrated values.

Figure 7:
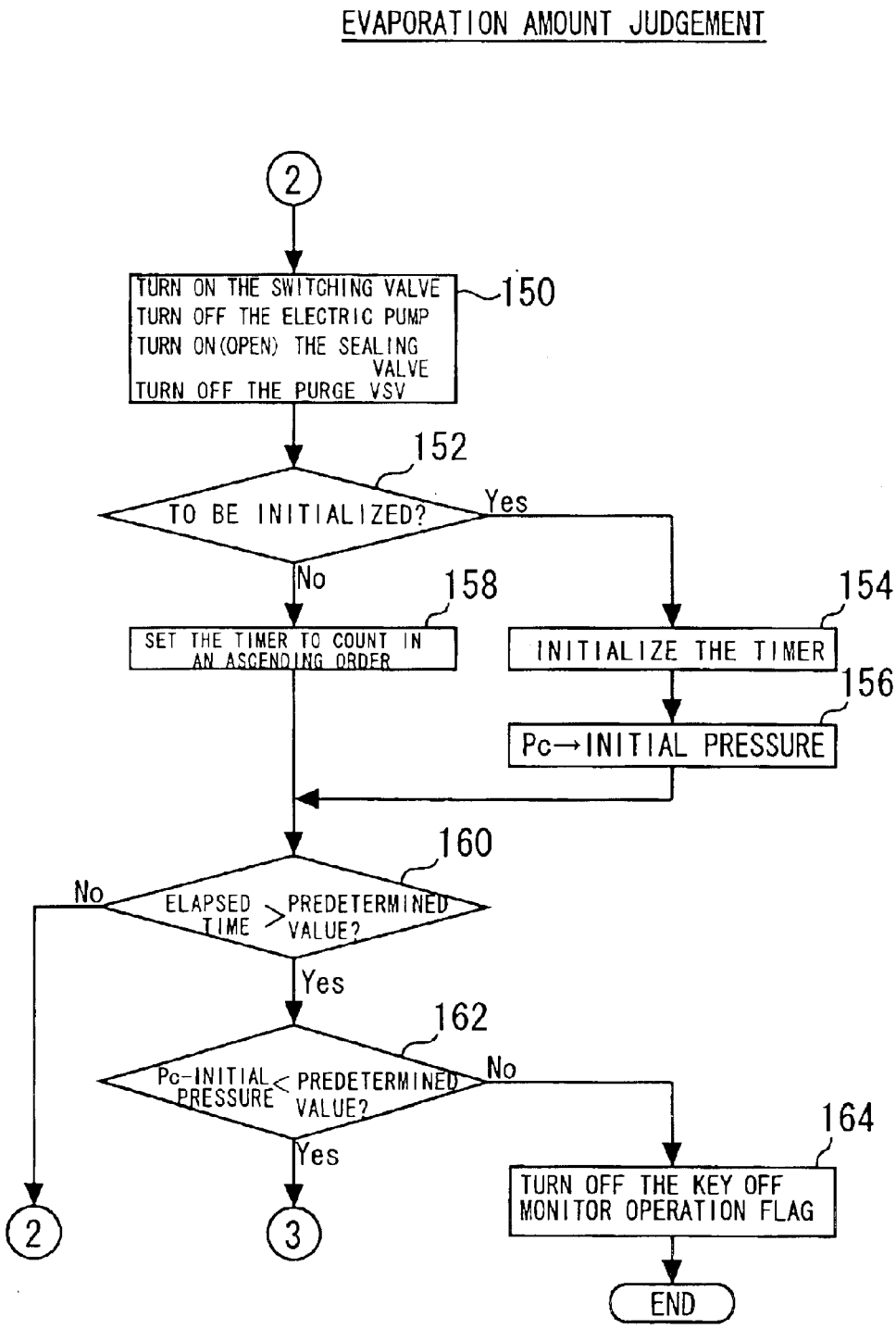
FIG. 7 is a flowchart illustrating a routine that is executed to implement evaporation amount judgment process by the evaporated fuel treatment device according to the first embodiment.

When processing step 144 above is completed, the routine shown in FIG. 7 is executed. FIG. 7 is a flowchart illustrating a routine that is executed by the ECU 60 to implement the "evaporation amount judgment process."

The routine shown in FIG. 7 first controls various elements' of the evaporated fuel treatment device as indicated below to invoke a state prevalent at time t3 shown in FIGS. 2A through 2F, that is, to form a hermetically closed space containing the fuel tank 10 and canister 26 (step 150):

Switching valve 80: ON

Pump 74: OFF

Sealing valve 28: ON (open)

Purge VSV 36: OFF

More specifically, the routine executes a process, after completion of the "atmospheric pressure judgment process," so that the switching valve 80 switches from the OFF state to the ON state.

After completion the above process, the routine determines whether or not to initialize the timer (step 152). If step 152 is performed for the first time after energization of the ECU 60, the routine concludes that timer initialization should be effected. In this instance, the routine executes a process for timer initialization (step 154) and then a process for memorizing the prevalent canister side pressure Pc as the initial pressure (step 156). If, on the other hand, step 152 was already performed during the time interval between the instant at which the ECU 60 began to become energized and the instant at which the current processing cycle started, the routine concludes that the timer need not be initialized. In this instance, the routine causes the timer to count up (step 158).

The routine shown in FIG. 7 then checks whether the elapsed time from the beginning of the present routine, that is, the elapsed time measured by the timer, is longer than a predetermined period of time that is defined as the period of evaporation amount judgment process execution (step 160).

If the result of the above check indicates that the elapse time is still not longer than the predetermined period of time, the routine repeats steps 150 and beyond. If, on the other hand, the result of the check indicates that the elapsed time is longer than the predetermined period of time, the routine then checks whether the difference between the prevalent canister side pressure Pc and the initial pressure memorized in step 156 (Pc—initial pressure) is smaller than a predetermined judgment value (step 162).

If the result of the check indicates that the pressure Pc minus the initial pressure is not smaller than the predetermined value, it can be concluded that the canister side pressure Pc significantly increased during evaporation amount judgment process execution. In this instance, it can also be concluded that a large amount of evaporated fuel is generated within the fuel tank 10.

For avoidance of erroneous detection, the abnormality detection process for the evaporated fuel treatment device should not be performed in situations where a large amount of evaporated fuel is generated. If the result of processing step 162 indicates that a large amount of evaporated fuel is generated within the fuel tank 10, the routine shown in FIG. 7 subsequently turns OFF the KEY OFF monitor operation flag (step 164).

If the KEY OFF monitor operation flag turns OFF, the power supply to the ECU 60 shuts off as described earlier to abort the abnormality detection process. Therefore, the routine shown in FIG. 7 makes it possible to prevent the abnormality detection process for the evaporated fuel treatment device from being continuously performed in situations where a large amount of evaporated fuel is generated.

If the routine shown in FIG. 7 finds in step 162 that the pressure Pc minus the initial pressure is smaller than the predetermined value, it can be concluded that an insignificant amount of evaporated fuel is generated. In such an instance, the routine shown in FIG. 8 is executed in order to continue with the abnormality detection process.

Figure 8:
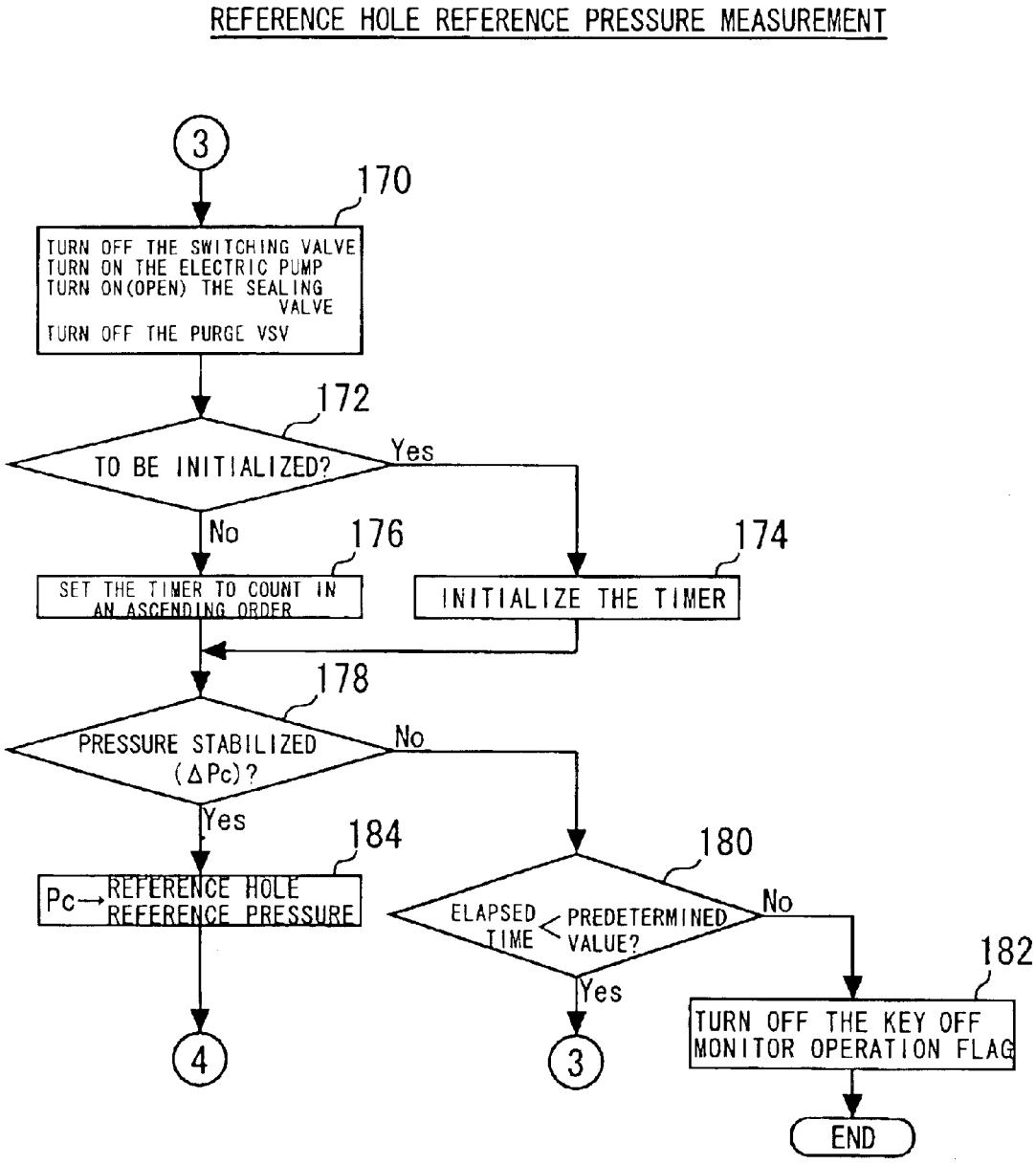
FIG. 8 is a flowchart illustrating a routine that is executed to implement 0.5 mm diameter reference hole check process by the evaporated fuel treatment device according to the first embodiment.

FIG. 8 is a flowchart illustrating a routine that is executed by the ECU 60 to implement the "0.5 mm diameter reference hole check process." The routine shown in FIG. 8 first controls various elements of the evaporated fuel treatment device as indicated below to invoke a state prevalent at time t4 shown in FIGS. 2A through 2F, that is, to generate a negative pressure around the pump module pressure sensor 86 on the presumption that the 0.5 mm diameter reference hole exists (step 170):

Switching valve 80: ON

Pump 74: ON

Sealing valve 28: ON (open)

Purge VSV 36: OFF

More specifically, the routine executes a process, after completion of the "evaporation amount judgment process," for the purpose of causing the switching valve 80 to switch from the ON state to the OFF state and the pump 74 to turn ON.

After completion of the above process, step 172 is performed to judge whether the timer should be initialized. If step 172 is performed for the first time after energization of the ECU 60, the routine concludes that timer initialization should be effected. In this instance, the routine executes a process for timer initialization (step 174).

If, on the other hand, step 172 was already performed during the time interval between the instant at which the ECU 60 began to become energized and the instant at which the current processing cycle started, the routine concludes that the timer need not be initialized. In this instance, the routine causes the timer to count in an ascending order (step 176). The routine shown in FIG. 8 judges whether the canister side pressure Pc is stabilized or not. More specifically, the routine checks whether the amount of change ΔPc in the canister side pressure Pc, which can be determined by checking the pressure value difference between the previous processing cycle and the current, is smaller than a predetermined judgment value (step 178).

If the result of the above check indicates that the pressure Pc is still not stabilized, the routine checks whether the elapsed time from the start of the present routine, that is, the elapsed time measured by the timer, is shorter than a predetermined period of time (step 180).

If the result of the above check indicates that the elapse time is still shorter than the predetermined period of time, the routine repeats steps 170 and beyond. If, on the other hand, the elapsed time is already equal to or longer than the predetermined period of time, the routine concludes that the encountered situation is inappropriate for abnormality detection process continuation, and then turns OFF the KEY OFF monitor operation flag (step 182).

If the system is normal, the canister side pressure Pc stabilizes at the 0.5 mm diameter hole judgment value before the elapsed time reaches the predetermined period of time. In this instance, the condition prescribed for step 178 above is established when the pressure Pc stabilizes. When the condition for step 178 is established, the routine shown in FIG. 8 memorizes the prevalent canister side pressure Pc as the 0.5 mm diameter hole judgment value (step 184).

Figure 9:
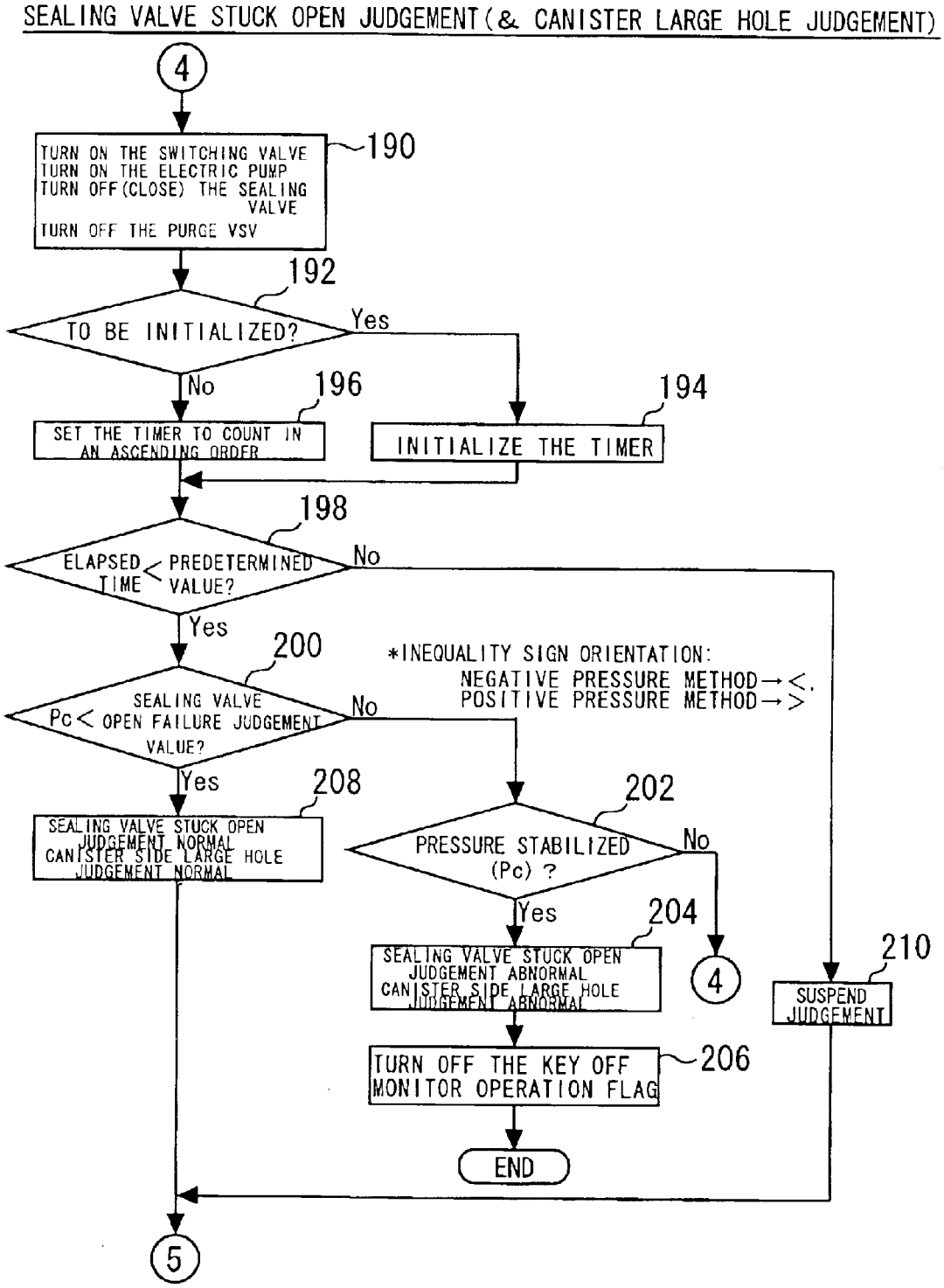
FIG. 9 is a flowchart illustrating a routine that is executed to detect an open failure of a sealing valve by the evaporated fuel treatment device according to the first embodiment.

After completing the "0.5 mm diameter reference hole check process" in accordance with the routine shown in FIG. 8, the ECU 60 executes a routine shown in FIG. 9. FIG. 9 is a flowchart illustrating a routine that is executed by the ECU 60 to detect an open failure of the sealing valve 28.

The routine shown in FIG. 9 first controls various elements of the evaporated fuel treatment device as indicated below to invoke a state prevalent at time t5 shown in FIGS. 2A through 2F, that is, to separate the canister 26 from the fuel tank 10, thereby allowing the pump 74 to decrease only the internal pressure of the canister 26 (step 190):

Switching valve 80: ON

Pump 74: ON

Sealing valve 28: OFF (closed)

Purge VSV 36: OFF

More specifically, step 190 is performed, after completion of the "0.5 mm diameter reference hole check process," so as to switch the sealing valve 28 from the ON state to the OFF state and the switching valve 80 from the OFF state to the ON state. While the switching valve 80 is OFF, the pump module pressure sensor 86 communicates with the canister 26 (under atmospheric pressure) via the reference orifice 84. If, on the other hand, the switching valve turns ON, the pump module pressure sensor 86 directly communicates with the canister 26. Therefore, the canister side pressure Pc momentarily changes to a great value at the moment processing step 190 is executed (see time t5).

After completion of the above process, the routine determines whether or not to initialize the timer (step 192). If step 192 is performed for the first time after energization of the ECU 60, the routine concludes that timer initialization should be effected. In this instance, the routine executes a process for timer initialization (step 194). If, on the other hand, step 192 was already performed during the time interval between the instant at which the ECU 60 began to become energized and the instant at which the current processing cycle started, the routine concludes that the timer need not be initialized. In this instance, the routine causes the timer to count in an ascending order (step 196).

The routine shown in FIG. 9 then checks whether the elapsed time from the beginning of the present routine, that is, the elapsed time measured by the timer, is shorter than a predetermined period of time that is defined as the maximum period for sealing valve OBD process execution (step 198).

If the result of the above check indicates that the elapse time is shorter than the predetermined period of time, the routine checks whether the prevalent canister side pressure Pc is smaller than an open failure judgment value for the sealing valve 28 (step 200). The open failure judgment value for the sealing valve 28 for use in step 200 may be a predetermined value or a value selected according to the 0.5 mm diameter hole judgment value.

If the canister side pressure Pc is found in step 200 to be not smaller than the open failure judgment value, the routine then checks whether the pressure Pc has converged to a stable value (step 202).

If the result of the above check indicates that the canister side pressure Pc has still not converged to a stable value, that is, the routine concludes that the pressure Pc is still on the decrease, the routine terminates the current processing cycle. In this case, the processing of steps 190 and beyond is repeatedly excused hereinafter.

If it is found in step 202 that the canister side pressure Pc has already converged to a stable value, it can be recognized that the canister side pressure Pc does not decrease to an appropriate value that should be reached when the sealing valve 28 closes. This phenomenon occurs only when the sealing valve 28 is not closed or when there is a large hole in the canister 26. Therefore, if it is found in step 202 that the pressure Pc has converged to a stable value, it is concluded that an open failure has occurred in the sealing valve 28 with a large hole made in the canister 26 (step 204). Then, the KEY OFF monitor operation flag subsequently turns OFF (step 206) and the routine terminates.

If the system is normal, the canister side pressure Pc decreases below the open failure judgment value before it converges to a stable value. In this instance, the condition prescribed for step 200 above is established when the pressure Pc decreases below the open failure judgment value. When the condition for step 200 is established, the routine shown in FIG. 9 concludes that there is no abnormality concerning an open failure in the sealing valve 28 or a large hole in the canister 26 (step 208).

If the pump module pressure sensor 86 or the pump 74 is abnormal, the canister side pressure Pc may fail to decrease below the open failure judgment value for an unduly long period of time and may fail to converge to a stable value no matter whether the sealing valve 28 is properly closed. In such a situation, it is not possible to accurately determine whether an open failure has occurred in the sealing valve 28.

If the above situation arises, the routine shown in FIG. 9 eventually concludes in step 198 that the elapsed time is not shorter than the predetermined period of time. If such a conclusion is formed in step 198, the routine will later decide to suspend judgment concerning the open failure in the sealing valve 28 (step 210).

When the routine forms a judgment in step 208 or a judgment in step 210, the open failure diagnostic check on the sealing valve 28 terminates. When the open failure diagnostic check ends in this manner, the ECU 60 terminates the routine shown in FIG. 9, and then executes a routine shown in FIG. 10, which will be described later, in order to conduct a close failure diagnostic check on the sealing valve 28.

It is assumed that the evaporated fuel treatment device according to the present embodiment conducts an open failure diagnostic check on the sealing valve 28 by a negative pressure method, which uses the pump 74 to render the canister side pressure Pc negative. However, the method for conducting an open failure diagnostic check on the sealing valve 28 is not limited to the above negative pressure method. More specifically, the canister side pressure Pc may be rendered positive (by a positive pressure method) in order to conduct an open failure diagnostic check on the sealing valve 28 while using the pump 74 for pressurization purposes. When this alternative method is used, the desired judgment function can be exercised by replacing processing step 200 above with an alternative process for judging "whether the value Pc is greater than the open failure judgment value (Pc>open failure judgment value)."

The hermetically closed space containing the canister 26 (the space enclosed by the negative pressure pump module 52, purge VSV 36, and sealing valve 28) is placed under an adequate negative pressure at the time when processing step 208 or 210 is executed. Thus, the ECU 60 starts a routine shown in FIG. 10 while a certain degree of negative pressure is stored within the hermetically closed space.

Figure 10:
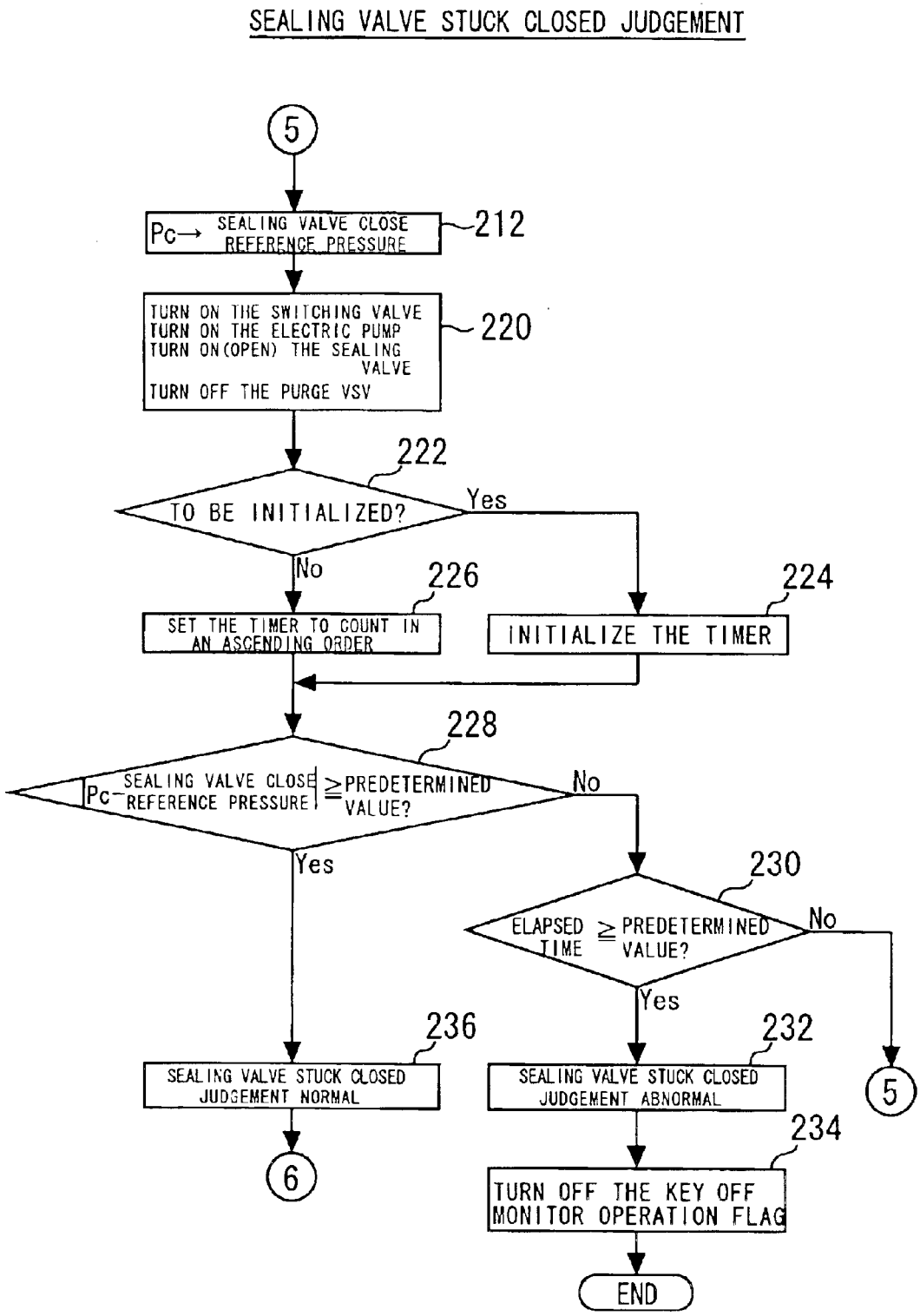
FIG. 10 is a flowchart illustrating a routine that is executed to conduct a close failure diagnostic check on the sealing valve by the evaporated fuel treatment device according to the first embodiment.

FIG. 10 is a flowchart illustrating a routine that is executed by the ECU 60 to conduct a close failure diagnostic check on the sealing valve 28. This routine first memorizes the canister side pressure Pc prevalent upon termination of an open failure diagnostic check on the sealing valve 28 (prevalent at time t6 in FIGS. 2A through 2F) as the sealing valve close reference pressure (step 212).

Next, the routine controls various elements of the evaporated fuel treatment device as indicated below to invoke a state prevalent after time t6 shown in FIGS. 2A through 2F (step 220):

Switching valve 80: ON

Pump 74: ON

Sealing valve 28: ON (open)

Purge VSV 36: OFF

More specifically, the routine executes a process, after termination of the open failure diagnostic check on the sealing valve 28, for the purpose of causing the sealing valve 28 to switch from the OFF state to the ON state.

After completion of the above process, the routine determines whether or not to initialize the timer (step 222). If step 222 is performed for the first time after energization of the ECU 60, the routine concludes that timer initialization should be effected. In this instance, the routine executes a process for timer initialization (step 224). If, on the other hand, step 222 was already performed during the time interval between the instant at which the ECU 60 began to become energized and the instant at which the current processing cycle started, the routine concludes that the timer need not be initialized. In this instance, the routine causes the timer to count in an ascending order (step 226).

The routine shown in FIG. 10 then checks whether the absolute value of the difference between the current canister side pressure Pc and the sealing valve close reference pressure memorized in step 212 is equal to or greater than a predetermined value. More specifically, the routine checks whether the canister side pressure Pc is significantly changed in processing step 220 in which the sealing valve 28 is turned ON (opened) (step 228).

When the open failure diagnostic check on the sealing valve 28 terminates (at time t6), the tank internal pressure Pt substantially equals to the atmospheric pressure. At such time, the pressure within the canister 26 is rendered adequately negative as described earlier. Therefore, when the sealing valve 28 properly opens in processing step 220, the gas in the fuel tank 10 subsequently flows to the canister 26, causing a great change in the canister side pressure Pc.

If it is found that the condition prescribed for step 228 is not established (no significant change is found in the pressure Pc), the routine shown in FIG. 10 then checks whether the elapsed time from the beginning of the present routine, that is, the elapsed time measured by the timer, is equal to or longer than a predetermined period of time (step 230).

If the result of the above check indicates that the elapse time is shorter than the predetermined period of time, the routine concludes that the canister side pressure Pc may still not be affected by the opening of the sealing valve 28, and then continues to perform processing steps 220 and beyond.

If, on the other hand, the elapsed time is found to be already equal to or longer than the predetermined period of time, it can be judged that the sealing valve 28 is not properly opened. In this instance, the ECU 60 concludes that the sealing valve 28 is stuck closed (step 232), turns OFF the KEY OFF monitor operation flag (step 234), and then terminates the routine shown in FIG. 10.

If the system is normal, the canister side pressure Pc significantly changes before the elapsed time reaches the predetermine period of time. The condition prescribed for step 228 is established at the time when such a significant change occurs in the pressure Pc. When the condition for step 228 is established, the routine shown in FIG. 10 concludes that there is no abnormality resulting from a close failure in the sealing valve 28 (step 236).

As described above, the routines shown in FIGS. 9 and 10 can conduct a close failure diagnostic check on the sealing valve 28 by using a negative pressure that is already stored in the space including the canister 26 at an open failure diagnostic check stage for the sealing valve 28 and without executing procedure for generating a differential pressure between both sides of the sealing valve 28. As a result, the evaporated fuel treatment device according to the present embodiment can efficiently conduct an abnormality diagnostic check on the sealing valve.

Although the foregoing description assumes that the open failure diagnostic check on the sealing valve 28 is conducted according to the negative pressure method, the open failure diagnostic check on the sealing valve 28 may alternatively be conducted according to the positive pressure method. If the positive pressure method is used, the canister side pressure Pc is rendered positive at the end of the open failure diagnostic check. Therefore, if the sealing valve 28 opens at time t6, the pressure Pc decreases. In step 228 shown in FIG. 10, the change in the pressure Pc is recognized on absolute value basis. Consequently, it is possible to check for a significant change without regard to the direction of a change in the pressure Pc. As a result, the close failure of the sealing valve 28 can be accurately checked for by following the routine shown in FIG. 10 even if the open failure diagnostic check on the sealing valve 28 is conducted according to the positive pressure method.

Figure 11:
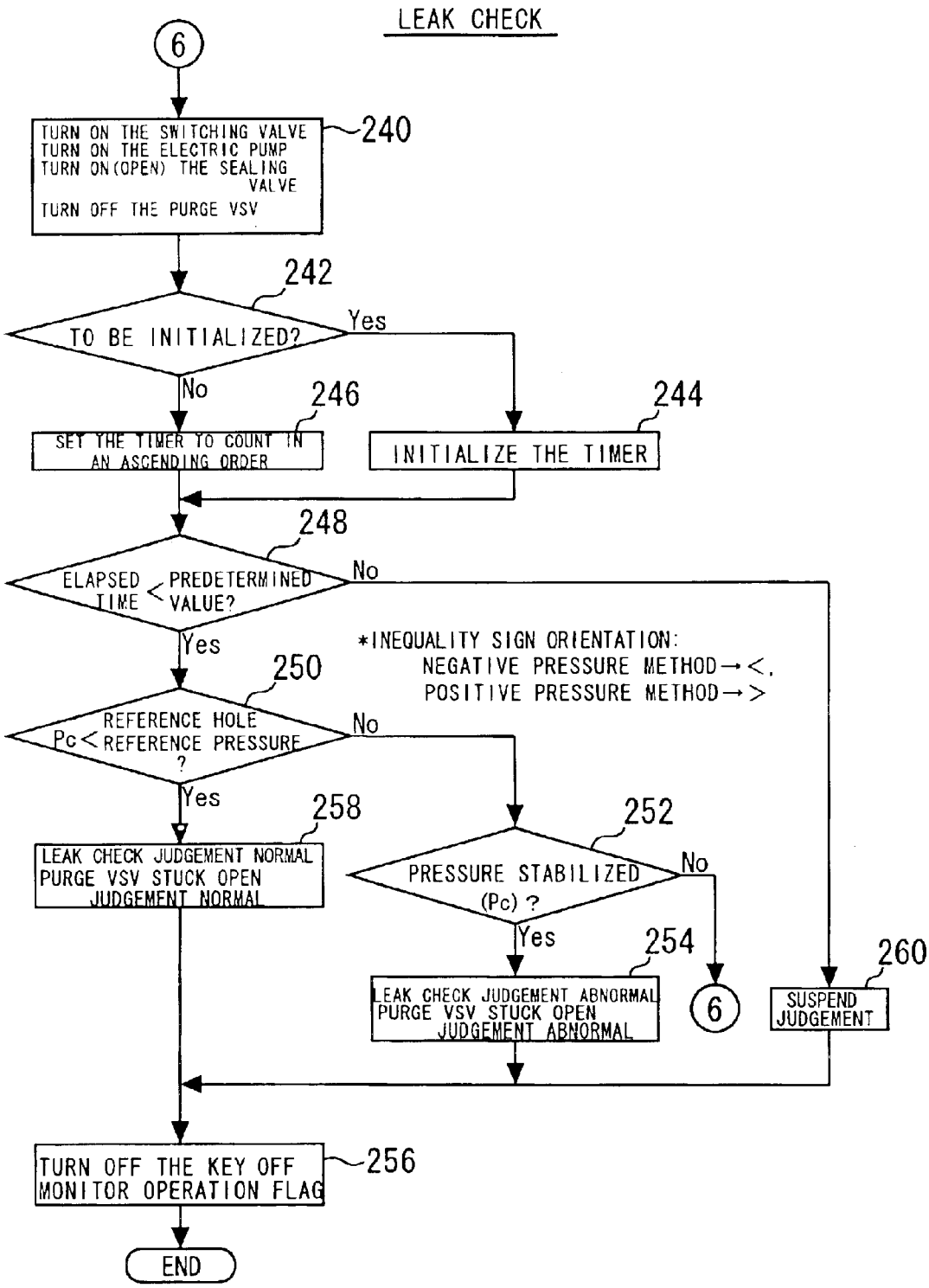
FIG. 11 is a flowchart illustrating a routine that is executed to implement 0.5 mm diameter leak check process by the evaporated fuel treatment device according to the first embodiment.

After completing the "sealing valve OBD process" in accordance with the routines shown in FIGS. 9 and 10, the ECU 60 executes a routine shown in FIG. 11. FIG. 11 is a flowchart illustrating a routine that is executed by the ECU 60 to implement the "0.5 mm diameter leak check process."

While the sealing valve OBD process is being executed (during the period from time t5 through time t6 in FIGS. 2A through 2F), the pump 74 continues to introduce a negative pressure. The above sealing valve OBD process can complete the close failure diagnostic check on the sealing valve 28 without allowing the negative pressure introduced during the above-mentioned period to be relieved to atmosphere. Therefore, the routine shown in FIG. 11 starts while the negative pressure introduced by the pump 74 during the execution period of sealing valve OBD process remains within the canister 26 and fuel tank 10.

The routine shown in FIG. 11 first controls various elements of the evaporated fuel treatment device as indicated below to invoke a state prevalent after time t6 shown in FIGS. 2A through 2F (step 240):

Switching valve 80: ON

Pump 74: ON

Sealing valve 28: ON (open)

Purge VSV 36: OFF

The above state is the same as invoked in step 220 shown in FIG. 10. In step 240, therefore, the actual status of the above elements does not change at all. As a result, the space containing the canister 26 and fuel tank 10 remains closed even after step 240 is executed. After execution of step 240, the degree of negative pressure in the hermetically closed space containing the canister 26 and fuel tank 10 is increased while the negative pressure introduced during the sealing valve OBD process is effectively utilized.

After completion of the above process, the routine determines whether or not to initialize the timer (step 242). If step 242 is performed for the first time after energization of the ECU 60, the routine concludes that timer initialization should be effected. In this instance, the routine executes a process for timer initialization (step 244). If, on the other hand, step 242 was already performed during the time interval between the instant at which the ECU 60 began to become energized and the instant at which the current processing cycle started, the routine concludes that the timer need not be initialized. In this instance, the routine causes the timer to count in an ascending order (step 246).

The routine shown in FIG. 11 then checks whether the elapsed time from the beginning of the present routine, that is, the elapsed time measured by the timer, is shorter than a predetermined period of time that is defined as the maximum permissible time for the 0.5 mm diameter leak check process (step 248).

If the result of the above check indicates that the elapse time is shorter than the predetermined period of time, the routine checks whether the current canister side pressure Pc is smaller than the 0.5 mm diameter hole judgment value memorized in step 184 (step 250).

If the canister side pressure Pc is found in step 250 to be not smaller than the 0.5 mm diameter hole judgment value, the routine then checks whether the pressure Pc has converged to a stable value (step 252).

If the result of the above check indicates that the canister side pressure Pc has still not converged to a stable value, that is, the routine concludes that the pressure Pc is still on the decrease, the routine terminates the current processing cycle. In this instance, the routine repeats steps 240 and beyond hereinafter.

If it is found in step 252 that the canister side pressure Pc has already converged to a stable value, it can be recognized that the canister side pressure Pc does not decrease to an appropriate value that should be reached. This phenomenon occurs only when there is a leak larger than 0.5 mm in diameter in the line containing the canister 26 and fuel tank 10 or the purge VSV 36 is not properly closed. Therefore, if it is found in step 252 that the pressure Pc has converged to a stable value, it is concluded that a leak (leak check error) or an open failure encountered in the purge VSV 36 has occurred (step 254). In this instance, the KEY OFF monitor operation flag subsequently turns OFF (step 256) and then the routine terminates.

If the system is normal, the canister side pressure Pc decreases below the 0.5 mm diameter hole judgment value before it converges to a stable value. In this instance, the condition prescribed for step 250 is established when the pressure Pc decreases below the 0.5 mm diameter hole judgment value. When the condition for step 250 is established, the routine shown in FIG. 11 concludes that there is no abnormality resulting from a leak or an open failure in the purge VSV 36 (step 258). After completion of the above process, the KEY OFF monitor operation flag turns OFF is step 256 and then the routine terminates.

If the pump module pressure sensor 86 or the pump 74 is abnormal, the canister side pressure Pc may fail to decrease below the 0.5 mm diameter hole judgment value for an unduly long period of time and may fail to converge to a stable value even when there is no leak in the line. In such a situation, it is not possible to accurately determine whether leakage has occurred.

If the above situation arises, the routine shown in FIG. 11 eventually concludes in step 248 that the elapsed time is not shorter than the predetermined period of time. If such a conclusion is formed in step 248, the routine will later decide to suspend judgment concerning leakage (step 260). After completion of the above process, the KEY OFF monitor operation flag turns OFF and then the routine terminates.

As described above, the routine shown in FIG. 11 can complete a leak check by increasing a negative pressure, while effectively utilizing a negative pressure which is introduced into the hermetically closed space containing the canister 26 and fuel tank 10 during sealing valve OBD process execution. Therefore, the evaporated fuel treatment device according to the present embodiment can efficiently complete the sealing valve OBD check and leak check processes by executing them in combination with each other.

Although the foregoing description assumes that a 0.5 mm diameter leak check is conducted according to the negative pressure method, the method for conducting a 0.5 mm diameter leak check is not limited to the above negative pressure method. More specifically, the 0.5 mm diameter leak check may alternatively be conducted according to the positive pressure method. If the positive pressure method is used, the desired judgment function can be exercised by replacing processing step 250 above with an alternative process for judging "whether the value Pc is greater than the 0.5 mm diameter hole judgment value (Pc>0.5 m diameter hole judgment value)."

Although the foregoing description of first embodiment assumes that the pump 74 communicates with the atmosphere hole 50 in the canister 26 in order to introduce a negative pressure into the canister 26 via the atmosphere hole 50, an alternative method may be employed for negative pressure introduction. For example, the atmosphere hole 50 may alternatively be equipped with an open/close valve, which isolates the canister 26 from the atmosphere, with a pump installed between the sealing valve 28 and the canister 26 in order to introduce the negative pressure into the canister from the vapor passage 20.

Second Embodiment

A second embodiment of the present invention will now be described with reference to FIG. 12. The evaporated fuel treatment device according to the present embodiment is implemented by modifying the evaporated fuel treatment device according to the first embodiment so as to execute a routine shown in FIG. 12, which will be described later, in place of the routine shown in FIG. 9.

Figure 12:
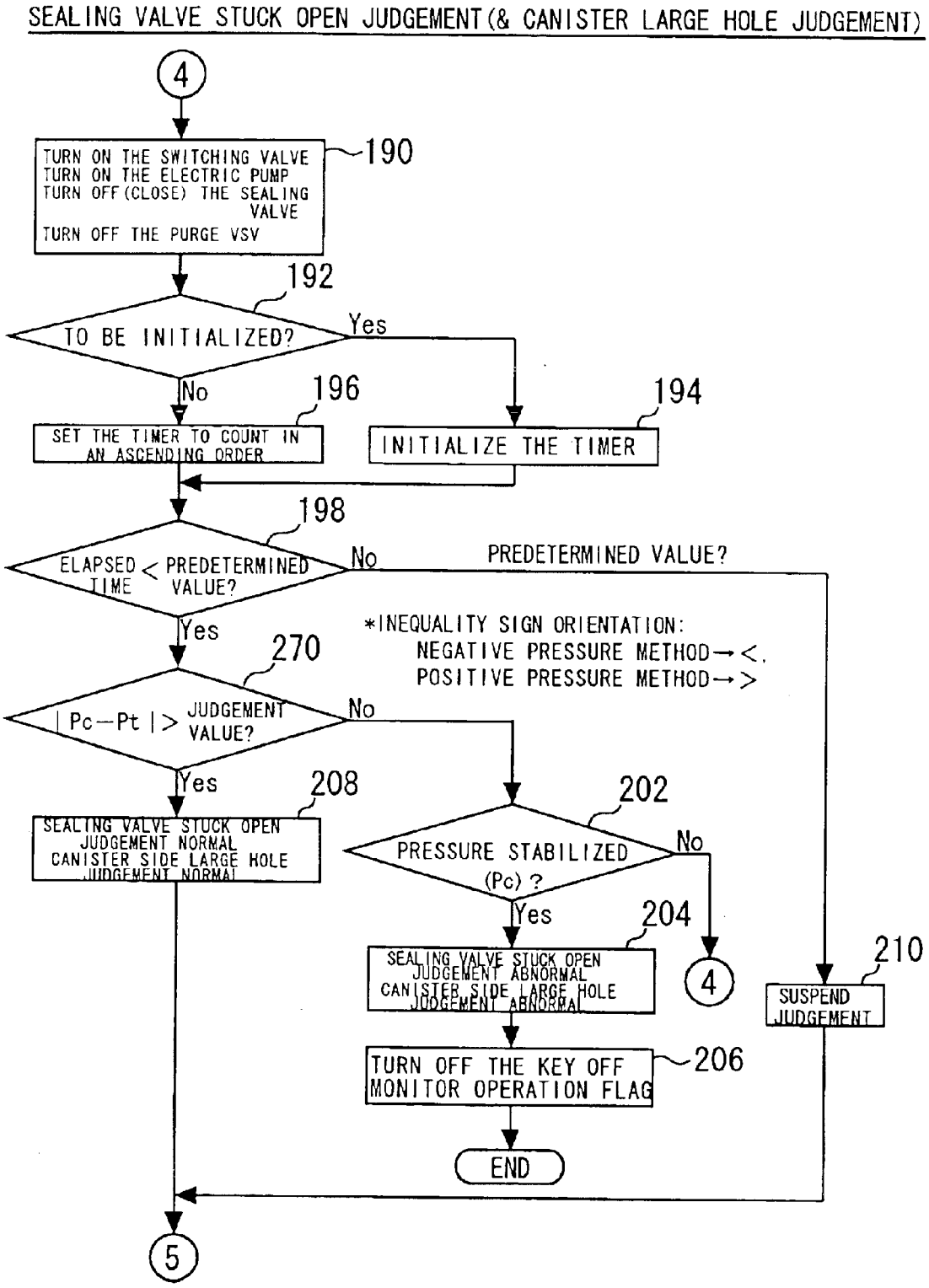
FIG. 12 is a flowchart illustrating a routine that is executed to conduct an open failure diagnostic check on the sealing valve by an evaporated fuel treatment device according to a second embodiment.

FIG. 12 is a flowchart illustrating a routine that is executed by the ECU 60 to conduct an open failure diagnostic check on the sealing valve 28. This routine is the same as the one shown in FIG. 9 except that the step for judging whether an open failure has occurred in the sealing valve 28 is changed from step 200 to step 270. When the present embodiment is described in reference to FIG. 12, steps identical with those described in reference to FIG. 9 are designated by the same reference numerals as their counterparts and omitted from the description or briefly described.

In the routine shown in FIG. 12, a check is made whether the difference between the prevalent canister side pressure Pc and the tank internal pressure Pt (|Pc−Pt|) is greater than a predetermined judgment value (step 270) when the elapsed time from the beginning of an open failure diagnostic check on the sealing valve 28 is found in step 198 to be shorter than a predetermined period of time. If the difference (|Pc−Pt|) is greater than the judgment value, the routine concludes in step 208 that there is no abnormality resulting from a stuck open sealing valve 28. If, on the other hand, such a condition is not established, the routine continues to execute processing steps 202 and beyond.

For an open failure diagnostic check on the sealing valve 28, a negative pressure is introduced into the canister 26 while the sealing valve 28 is closed. If the sealing valve 28 is properly closed in this instance, the value |Pc−Pt| should be greater than the judgment value as expected because a significant differential pressure is generated between both sides of the sealing valve 28. If, on the other hand, the sealing valve 28 is not properly closed, it is conceivable that value |Pc−Pt| may not be greater than the judgment value because no significant differential pressure is generated between both sides of the sealing valve 28. Therefore, processing step 270 can accurately judge, as is the case with step 200, whether an open failure has occurred in the sealing valve 28. As a result, the evaporated fuel treatment device of the present embodiment can implement the same functionality as that of the first embodiment.

Although the above description of the present embodiment assumes that the open failure diagnostic check on the sealing valve 28 is conducted according to the negative pressure method, the positive pressure method may alternatively be used for the open failure diagnostic check on the sealing valve 28. Step 270 shown in FIG. 12 recognizes the difference between the values Pc and Pt on absolute value basis. It is therefore possible to determine whether there is a significant difference between the two values no matter whether the positive pressure method or negative pressure method is employed. Therefore, the routine shown in FIG. 12 can conduct an accurate diagnostic check even when the positive pressure method is used to check the sealing valve 28 for an open failure.

Third Embodiment

A third embodiment of the present invention will now be described with reference to FIGS. 13A through 16. FIGS. 13A through 13E are timing diagrams illustrating an abnormality detection process that is performed by the evaporated fuel treatment device of the present embodiment. The evaporated fuel treatment device according to the present embodiment is implemented by modifying the device according to the first embodiment such that the ECU 60 executes an abnormality detection process by following a sequence shown in FIG. 13. For the purpose of minimizing the influence of various disturbances, the abnormality detection process according to the present embodiment is performed while the vehicle is parked, as is the case with the first embodiment.

The abnormality detection process according to the present embodiment (in compliance with the sequence indicated in FIG. 13) is substantially the same as that is performed in accordance with the first embodiment (in compliance with the sequence indicated in FIGS. 2A through 2F) except for the following five points:

(1) A hermetic pressure check process (described later) is executed (time t1 to time t2) prior to the atmospheric pressure judgment process.

(2) The evaporation amount judgment process is deleted although it is performed subsequently to the atmospheric pressure judgment process in the sequence indicated in FIGS. 2A through 2F.

(3) The sealing valve 28 is closed during the atmospheric pressure judgment process (time t2 to time t3) and 0.5 mm diameter reference hole check process (time t3 to time t4).

(4) When a valve open failure diagnostic check is conducted on the sealing valve 28, a valve close instruction is issued (at time t6) within a short period of time after valve open instruction issuance to the sealing valve 28 (at time t5).

(5) The 0.5 mm diameter leak check process (time t7 to time t8) is not performed if the airtightness of the fuel tank 10 is verified by the hermetic pressure check process (time t1 to time t2).

The abnormality detection process of the present embodiment will now be described primarily with reference to the above differences. As is the case with the first embodiment, the ECU 60 is started up to initiate the abnormality detection process (at time t1) when the soak timer reaches a predetermined count (e.g., five hours) after internal-combustion engine stoppage.

The evaporated fuel treatment device of the present embodiment generally closes the sealing valve 28 while the vehicle is parked. Therefore, if the system is normal, the fuel tank 10 is hermetically closed at time t1. After time t1, the ECU 60 detects the prevalent tank internal pressure Pt as the pressure prevalent in a hermetically closed state, that is, the hermetic pressure. Then, the ECU 60 checks the fuel tank 10 for airtightness by determining whether the hermetic pressure is adequately different from the atmospheric pressure. In the present embodiment, this check is referred to as the "hermetic pressure check."

If the volume of the gas in the tank changes with evaporated fuel evaporation or liquefaction after internal-combustion engine stoppage in situations where there is a leak in the fuel tank 10, air comes in and out of the leak so as to compensate for such a volumetric change. In such an instance, the tank internal pressure Pt generated at time t1 is not adequately different from the atmospheric pressure. Therefore, if it is found in the above hermetic pressure check that the tank internal pressure Pt is different from the atmospheric pressure, it can be judged that the fuel tank 10 is hermetically closed. When such a judgment is formulated, the evaporated fuel treatment device of the present embodiment subsequently skips the process for conducting a leak check on the fuel tank 10.

FIG. 13D shows a case where the tank internal pressure Pt is close to the atmospheric pressure at the time of hermetic pressure check process execution. Even when the fuel tank 10 is hermetically closed, the tank internal pressure Pt may occasionally be equivalent to the atmospheric pressure at the time of hermetic pressure check process execution depending on the environment in which the internal-combustion engine is placed. Therefore, in a case where the tank internal pressure Pt is not adequately different from the atmospheric pressure during the hermetic pressure check, it is impossible to judge at the time point whether or not the fuel tank 10 is hermetically closed. In such an instance, the ECU 60 conducts after termination of the sealing valve OBD process a 0.5 mm diameter leak check process for the space containing the fuel tank 10 (time t7 to time t8).

Upon termination of the hermetic pressure check, the atmospheric pressure judgment process is executed (time t2 to time t3). In the present embodiment, the atmospheric pressure judgment process is performed while the sealing valve 28 is closed only for compensating the output of the pump module pressure sensor 86. The method for output compensation is not described in detail herein because it is substantially the same as that is used by the first embodiment.

After termination of the atmospheric pressure judgment process, the 0.5 mm diameter reference hole check process is executed (time t3 to time t4). In the present embodiment, the 0.5 mm diameter reference hole check process is also performed while the sealing valve 28 is closed. The process is not described in detail herein because it is substantially the same as that is performed in the first embodiment.

After termination of the 0.5 mm diameter reference hole check process, the sealing valve OBD process is executed. In the sealing valve OBD process, an open failure diagnostic check is first conducted on the sealing valve 28 (time t4 to time t5). If the result of the check indicates that an open failure has not occurred in the sealing valve 28, a close failure diagnostic check is conducted on the sealing valve 28 (time t5 to time t6).

The method for conducting the open failure diagnostic check is not described in detail herein because it is substantially the same as that is used in the first embodiment. As is the case with the first embodiment, the negative pressure introduced in during the open failure diagnostic check process is stored within the hermetically closed space on the side toward the canister 26 at the beginning of the close failure diagnostic check (time t5). In the present embodiment, the ECU 60 conducts the close failure diagnostic check on the sealing valve 28 while utilizing the negative pressure as in the first embodiment. More concretely, the ECU 60 issues a valve open instruction to the sealing valve 28 at time t5, and then issues a valve close instruction to the sealing valve 28 when a predetermined period of time elapses later (at time t6). The ECU 60 checks for a significant change in the canister side pressure Pc between time t5 and time t6 in order to determine whether a close failure has occurred in the sealing valve 28.

The close failure diagnostic check method used in the present embodiment differs from that is used in the first embodiment because the former stops the pump 74 at the moment a valve open instruction is issued to the sealing valve 28 (time t5), and issues, after an elapse of predetermined period of time, a valve close instruction to the sealing valve 28 with the switching valve 80 returned to its normal state. The above-mentioned predetermined period of time is the minimum time required for invoking a change in the canister side pressure Pc that can be detected by the pump module pressure sensor 86 when the sealing valve 28 properly operates. The use of the above method makes it possible to conduct an accurate close failure diagnostic check on the sealing valve 28 while minimizing the period of time during which the fuel tank 10 is not hermetically closed during the close failure diagnostic check process for the sealing valve 28. As a result, the evaporated fuel treatment device of the present embodiment is capable of conducting a close failure diagnostic check on the sealing valve accurately and efficiently while creating a favorable situation for preventing the evaporated fuel from being emitted to the atmosphere.

When the sealing valve OBD process terminates (time t6), the pump 74 stops with the switching valve 80 placed in the normal state and the sealing valve 28 closed as indicated in FIGS. 13A through 13E. In this instance, the space on the side toward the canister 26 is relieved to atmosphere while the fuel tank 10 remains hermetically closed.

If it can be concluded at the above hermetic pressure check stage that there is no leak in the fuel tank 10, the abnormality detection process now terminates. If, on the other hand, judgment concerning leakage in the fuel tank 10 is suspended, the sealing valve 28 opens after an elapse of a predetermined period of time (at time t7) to let the switching valve 80 introduce the atmosphere and operate the pump 74, thereby conducting a 0.5 mm diameter leak check on the space containing both the canister 26 and fuel tank 10 (time t7 to time t8). The above process is not described in detail herein because it is substantially the same as that is performed in embodiment 1.

Figure 13:
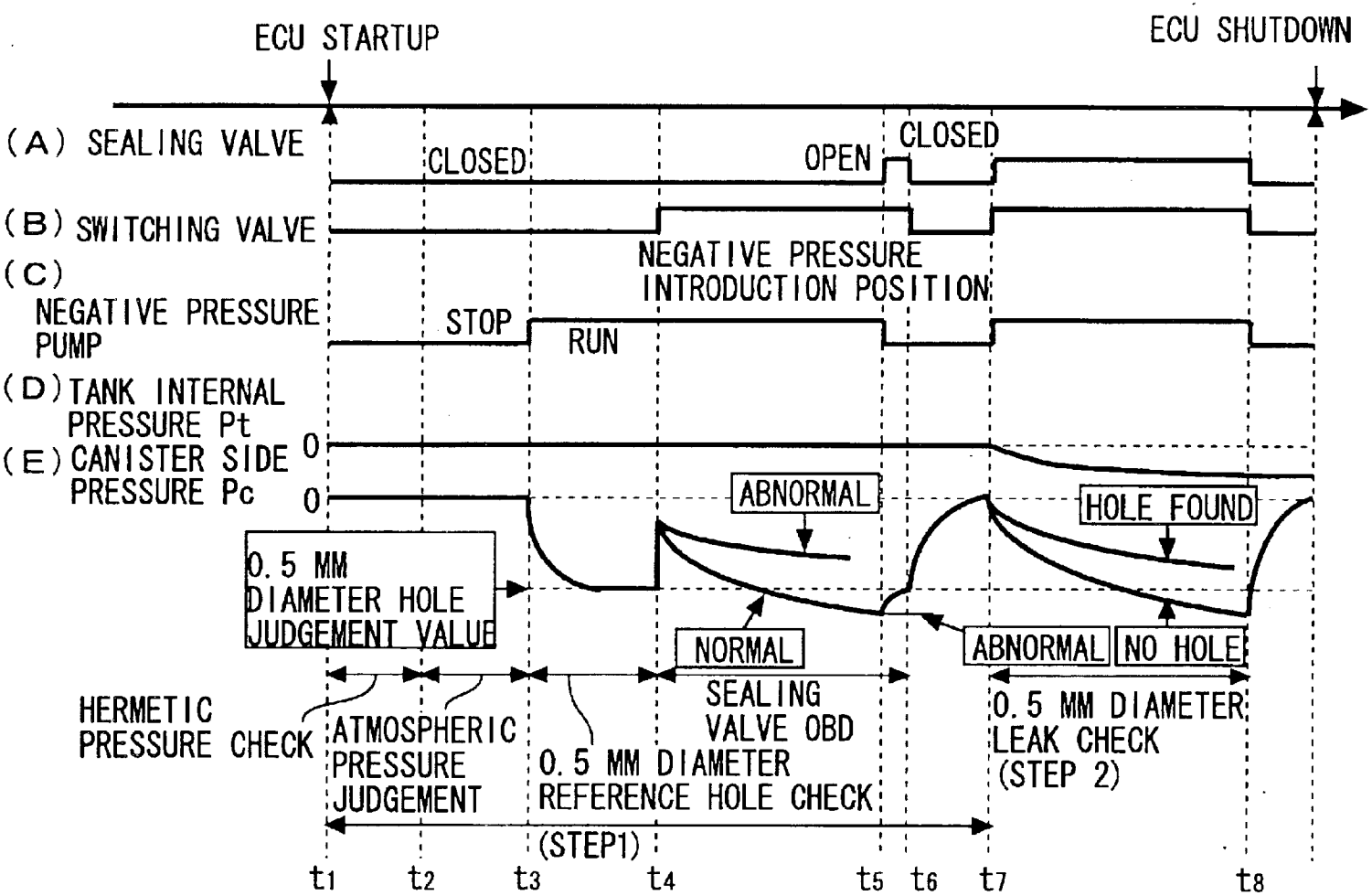
FIGS. 13A through 13E are timing diagrams illustrating a basic operation of abnormality detection process that is performed by an evaporated fuel treatment device according to a third embodiment.
Figure 14:
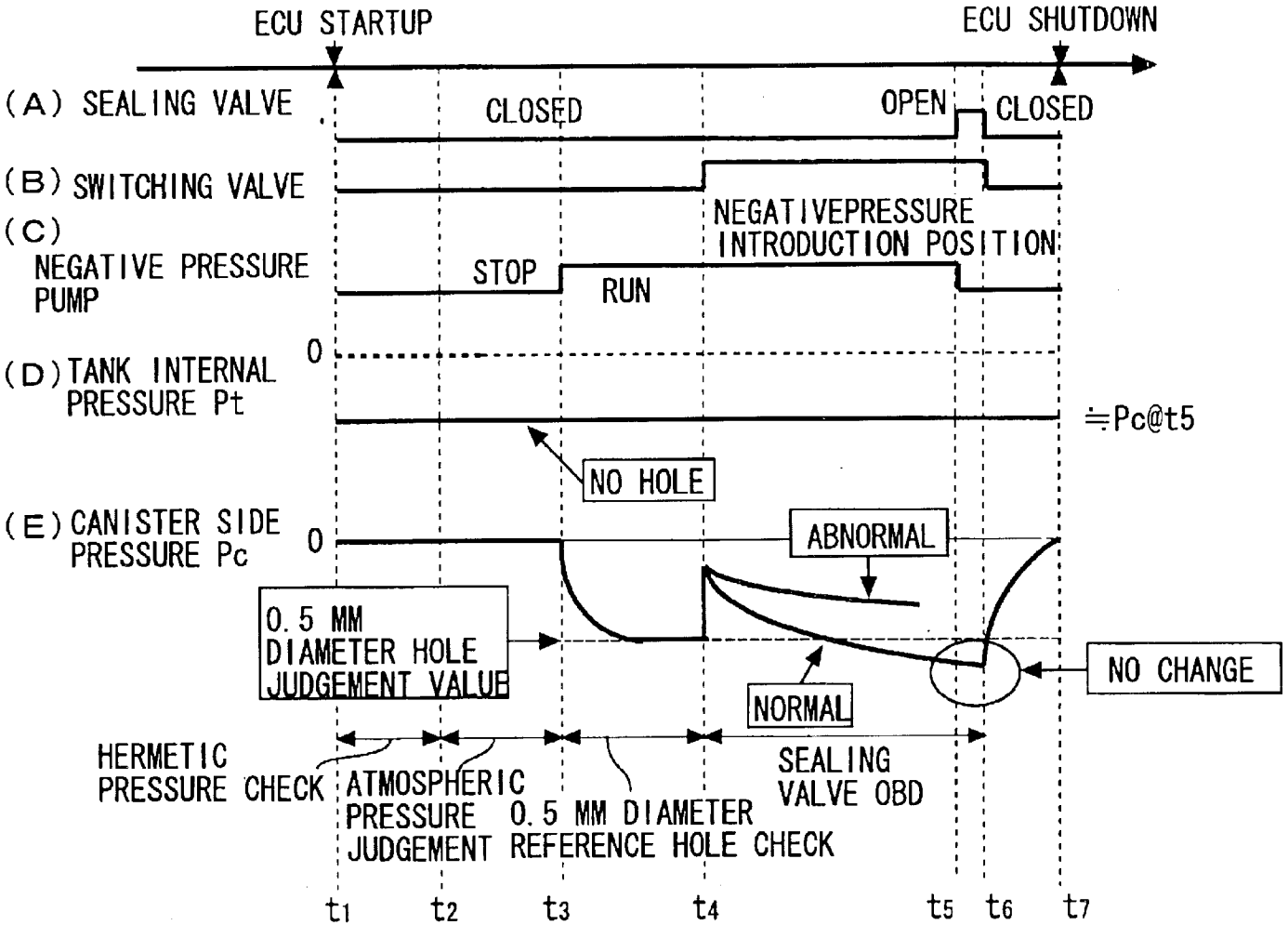
FIGS. 14A through 14E are timing diagrams illustrating a problem which may occur in the device according to the third embodiment.

As described above, the open and close failure diagnostic checks of the sealing valve 28 and the whole system leakage check can be sequentially conducted by following the sequence shown in FIG. 13. When the sequence is followed, it is also possible to conduct a close failure diagnostic check on the sealing valve 28 efficiently by making effective use of the negative pressure introduced during the open failure diagnostic check.

In the above sequence indicated in FIG. 13, the sealing valve 28 remains closed during the time interval between the instant at which the abnormality detection process is started and the instant at which a close failure diagnostic check is conducted on the sealing valve 28 (time t5). When the sequence according to the present embodiment is followed, therefore, the tank internal pressure Pt may occasionally be different from the atmospheric pressure at the time when a close failure diagnostic check on the sealing valve 28 begins.

FIGS. 14A through 14E are timing diagrams illustrating a sequence that is followed for abnormality detection process execution when the tank internal pressure Pt happens to be equal to the canister side pressure Pc that is produced at time t5. As described earlier, the evaporated fuel treatment device of the present embodiment conducts a close failure diagnostic check on the sealing valve 28 by making use of the negative pressure that is introduced into the canister 26 during the open failure diagnostic check on the sealing valve 28. If the pressure produced within the space on the side toward the canister 26 at the end of the open failure diagnostic check (time t5) differs from the prevalent tank internal pressure Pt, the canister side pressure Pc changes simultaneously when the sealing valve 28 opens as a result of the close failure diagnostic check.

However, if the canister side pressure Pc coincides with the tank internal pressure Pt at time t5 and before the sealing valve 28 opens, the canister side pressure Pc does not change at all even if the sealing valve 28 properly opens (see FIG. 14E). Under this circumstance, it may be erroneously recognized that a close failure has occurred in the sealing valve 28 because no significant change occurred in the canister side pressure Pc upon issuance of a valve open instruction. To avoid such an erroneous diagnostic check result, the evaporated fuel treatment device of the present embodiment checks, at the time of sealing valve close failure diagnostic check execution, whether a proper differential pressure is generated between both sides of the sealing valve 28. If a proper differential pressure is not generated, the evaporated fuel treatment device of the present embodiment generates a proper differential pressure and then conducts a close failure diagnostic check.

FIGS. 15A through 15F are timing diagrams illustrating the operations in which the functionality described above is incorporated. In the sequence indicated in FIGS. 15A through 15E, a check is made whether an adequate difference exists between the canister side pressure Pc and the tank internal pressure Pt at the beginning of a close failure diagnostic check on the sealing valve 28 (time t5). If the result of the check indicates that an adequate differential pressure exists, a valve open instruction is immediately issued to the sealing valve 28 as shown in FIG. 13A. If, on the other hand, the result of the check indicates that there is no adequate differential pressure, an atmosphere introduction process is initiated as shown in FIGS. 15A through 15E.

The atmosphere introduction process is implemented by placing the switching valve 80 in the normal state and bringing the pump 74 to a stop while keeping the sealing valve 28 closed. Being capable of raising the canister 26 side pressure Pc to a level close to the atmospheric pressure while maintaining the tank internal pressure Pt, the atmosphere introduction process can produce an adequate difference between the canister side pressure Pc and tank internal pressure Pt.

FIGS. 15A through 15E show an example in which the canister side pressure Pc is raised to the atmospheric pressure level by the atmosphere introduction process. To conduct a close failure diagnostic check on the sealing valve 28, it is necessary that a proper differential pressure be generated between both sides of the sealing valve 28. However, if an excessive difference pressure is generated between both sides of the sealing valve 28, an excessive amount of gas is exchanged between the fuel tank 10 and canister 26 when the sealing valve 28 opens. Such an excessive gas exchange causes various problems such as evaporated fuel blow-through and an undue increase in the tank internal pressure Pt after the abnormality detection process.

Therefore, the evaporated fuel treatment device of the present embodiment executes, after termination of the atmosphere introduction process, a negative pressure reintroduction process (time T1 to time T2) until the canister side pressure Pc decreases to a proper level. The negative pressure reintroduction process can be implemented by placing the switching valve 80 in a negative pressure introduction state and operating the pump 74 while keeping the sealing valve 28 closed. When this process is executed, the differential pressure generated between both sides of the sealing valve 28 can be lowered to a proper level by properly rendering the canister side pressure Pc negative.

After termination of the negative pressure reintroduction process, a close failure diagnostic check is conducted on the sealing valve 28 (time T2 to time t6) in the sequence that has been described with reference to FIGS. 13A through 13E. In this instance, a valve open instruction is issued to the sealing valve 28 while a proper differential pressure is generated between both sides of the sealing valve 28. Therefore, a check whether a close failure has occurred in the sealing valve 28 can be accurately made on the basis whether a significant change arises in the canister side pressure Pc after the issuance of the valve open instruction.

Figure 16:
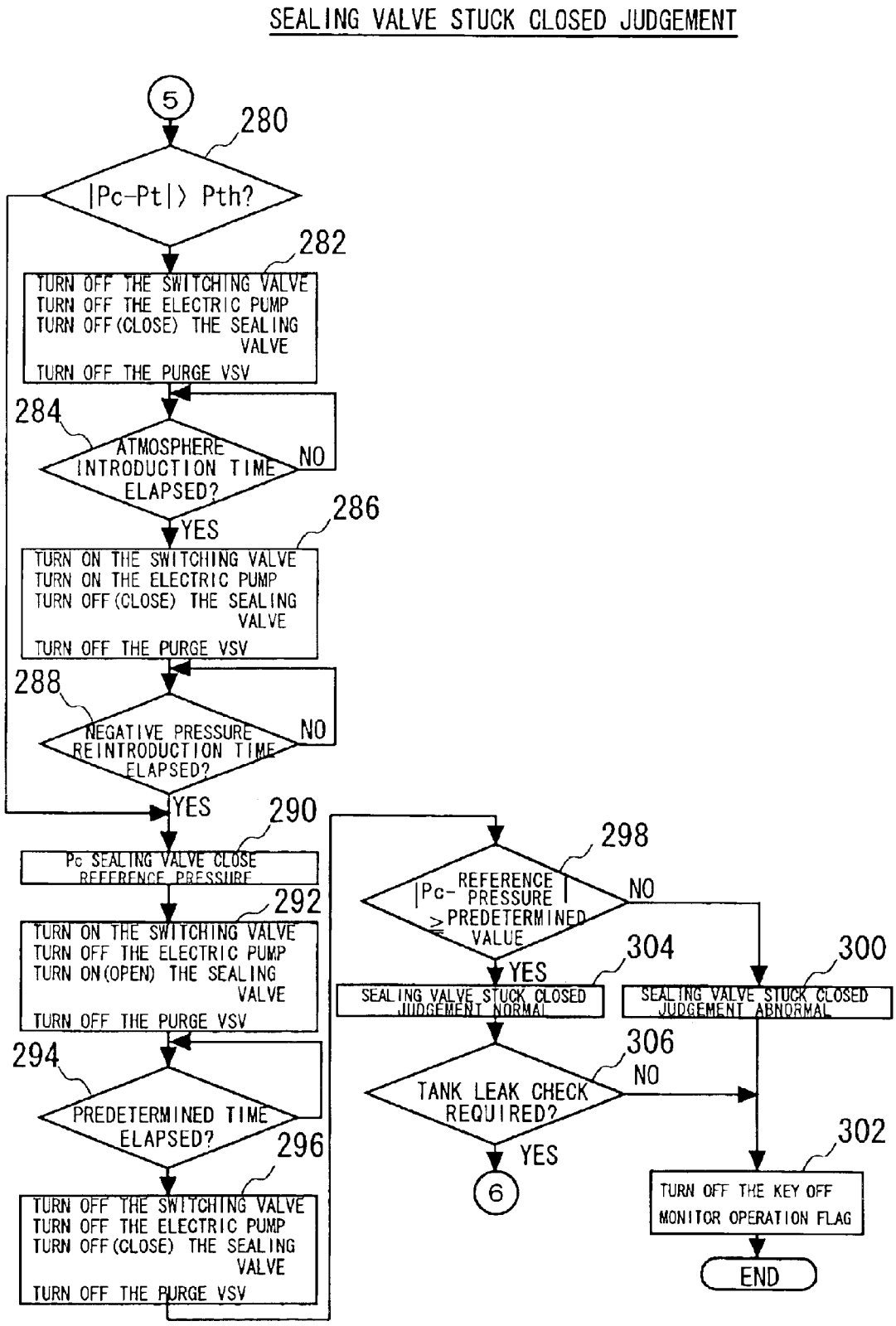
FIG. 16 is a flowchart illustrating a routine that is executed to conduct a close failure diagnostic check on the sealing valve by the evaporated fuel treatment device according to the third embodiment.
Figure 17:
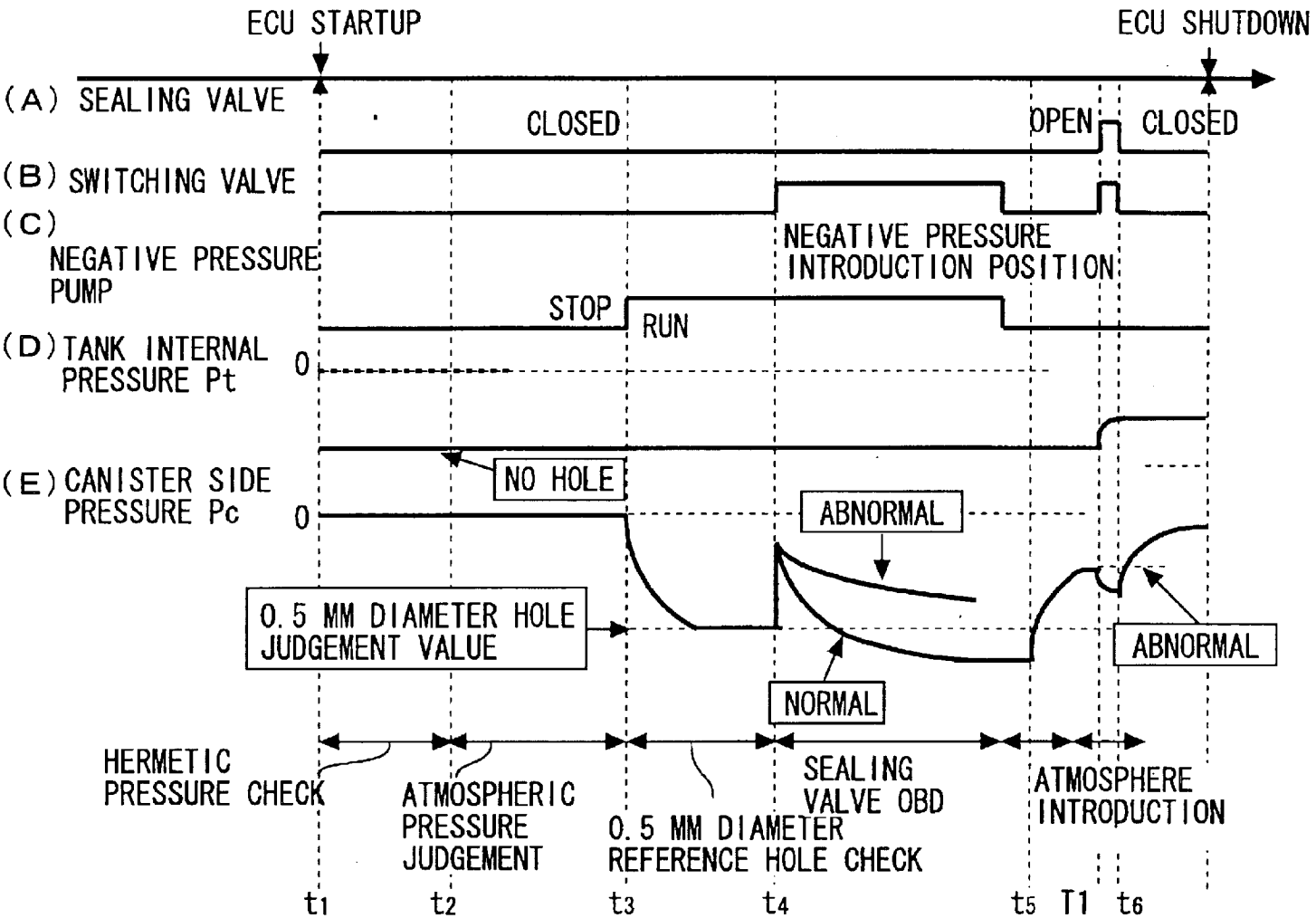
FIGS. 17A through 17E are timing diagrams illustrating a variation of the operation implemented by the evaporated fuel treatment device according to the third embodiment.

FIG. 16 is a flowchart illustrating a routine that is executed by the ECU 60 to conduct a close failure diagnostic check on the sealing valve 28 in the sequence described above. In addition to the routine shown in FIG. 16, the ECU 60 according to the present embodiment executes the routines for implementing various processes including those for hermetic pressure check, atmospheric pressure judgment, 0.5 mm diameter reference hole check, and sealing valve open failure diagnostic check. These routines are not described in detail herein because they are basically the same as those executed in the first embodiment (the routines shown in FIGS. 3 through 9 and FIG. 11). Further, the routine shown in FIG. 16 corresponds to a routine that is followed by the first embodiment as indicated in FIG. 10, and should be executed between an open failure diagnostic check routine corresponding to the routine shown in FIG. 9 and a leak check routine corresponding to the routine shown in FIG. 11.

That is, the ECU 60 executes the routine shown in FIG. 16 after terminating the open failure diagnostic check on the sealing valve 28 in accordance with the present embodiment. When the open failure diagnostic check is terminated, a negative pressure is stored in the space on the side toward the canister 26 with the sealing valve 28 closed. While the negative pressure is stored in the above manner, the routine shown in FIG. 16 first checks whether the difference between the canister side pressure Pc and the tank internal pressure Pt ($|Pc-Pt|$) is greater than a predetermined judgment value Pth (step 280).

If the result of the check indicates that $|Pc-Pt|$ is greater than Pth, it can be judged that a close failure diagnostic check can be properly conducted if a valve open instruction is issued to the sealing valve 28 in the current state. In this instance, the routine skips steps 282 to 288 and immediately proceeds to perform processing steps 290 and beyond.

If, on the other hand, it is found in step 280 that $|Pc-Pt|$ is not greater than Pth, the routine initiates an atmosphere introduction process so as to generate a differential pressure across the sealing valve 28 (step 282). More specifically, the routine controls various elements of the evaporated fuel treatment device as indicated below:

Switching valve 80: OFF

Pump 74: OFF

Sealing valve 28: OFF (closed)

Purge VSV 36: OFF

In the above process, the atmosphere can be introduced into the space on the side toward the canister 26 while the sealing valve 28 is closed. The routine shown in FIG. 16 waits for a predetermined period of time (step 282) after the start of atmosphere introduction, and then initiates a negative pressure reintroduction process (step 284). More specifically, the routine controls various elements of the evaporated fuel treatment device as indicated below:

Switching valve 80: ON

Pump 74: ON

Sealing valve 28: OFF (closed)

Purge VSV 36: OFF

In the above process, it is possible to raise the canister side pressure Pc to a level close to the atmospheric pressure and then reintroduce a negative pressure into the space on the side toward the canister 26. The routine shown in FIG. 16 waits for a period of time that is required for the canister side pressure Pc to become appropriately negative, and then starts a close failure diagnostic check on the sealing valve 28.

In the close failure diagnostic check on the sealing valve 28, the prevalent canister side pressure Pc (the pressure existing at time T2 in FIG. 15) is memorized as the sealing valve close reference pressure (step 290).

Figure 15:
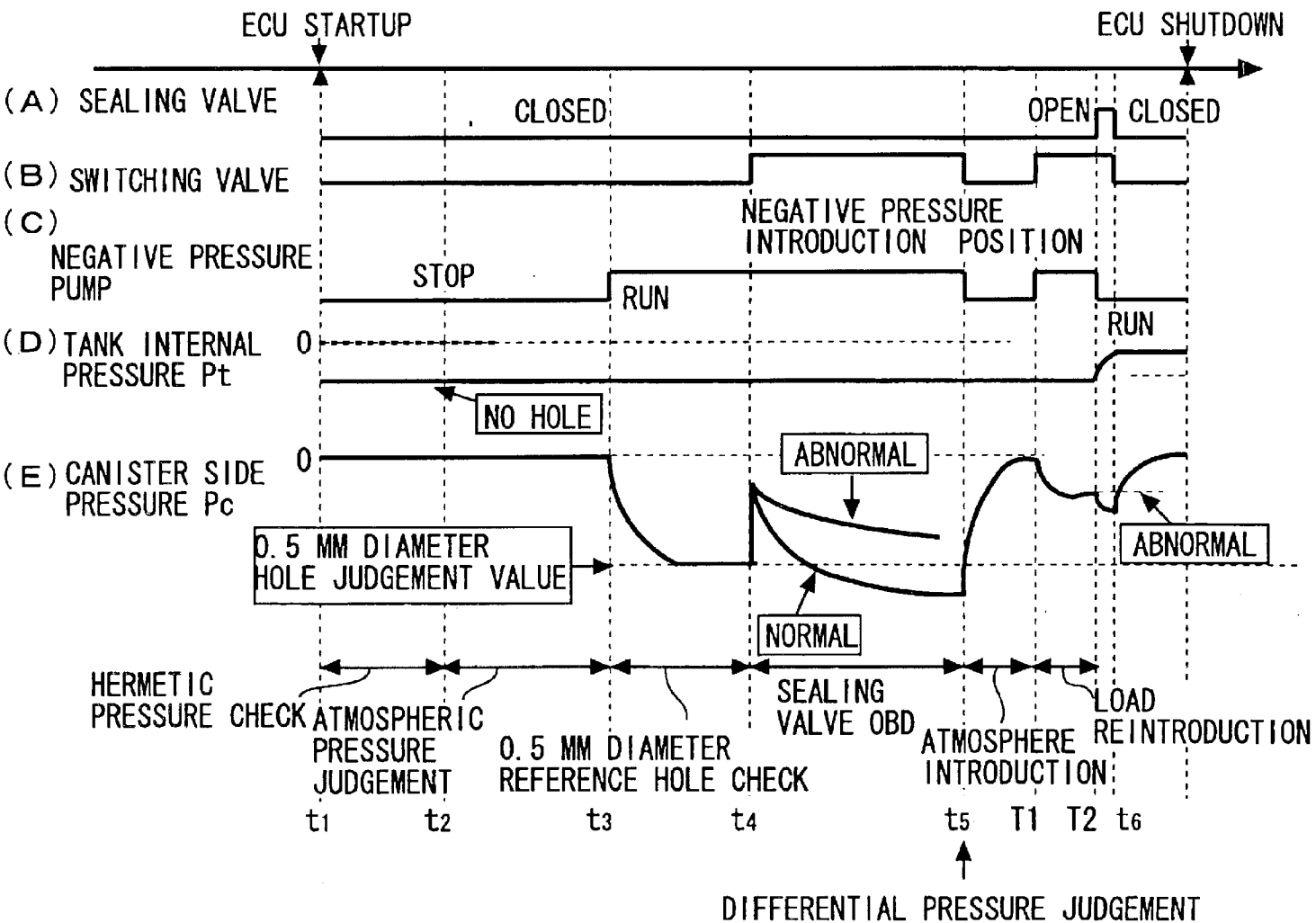
FIGS. 15A through 15E are timing diagrams illustrating an operation implemented by the evaporated fuel treatment device according to the third embodiment.

To invoke a state prevalent after time T2 as indicated in FIG. 15, the routine controls various elements of the evaporated fuel treatment device as indicated below (step 292):

Switching valve 80: ON

Pump 74: OFF

Sealing valve 28: ON (open)

Purge VSV 36: OFF

More specifically, a process is executed in order to change the status of the sealing valve 28 from OFF to ON after the open failure diagnostic check on the sealing valve 28.

In the above process, the sealing valve 28 opens so that both the tank internal pressure Pt and canister side pressure Pc change in such a manner as to decrease the difference between them. The routine shown in FIG. 16 waits a predetermined minimum time required for causing a change in the canister side pressure Pc that can be detected by the pump module pressure sensor 86 after the sealing valve 28 opens normally (step 294) before controlling various elements of the evaporated fuel treatment device as indicated below in order to terminate the negative pressure reintroduction process (step 296):

Switching valve 80: OFF

Pump 74: OFF

Sealing valve 28: OFF (closed)

Purge VSV 36: OFF

More specifically, the routine issues a valve close instruction to the sealing valve 28 and places the switching valve 80 in the normal state (nonenergized state). The above process makes it possible to hermetically close the fuel tank 10 and relieve the canister side space to atmosphere.

Upon termination of the negative pressure reintroduction process, the routine checks at time t6 indicated in FIG. 15 whether the difference between the canister side pressure Pc and sealing valve close reference pressure is equal to or greater than a predetermined value. In other words, the routine checks whether the canister side pressure Pc is significantly changed during the period during which a valve open instruction is issued to the sealing valve 28 (step 298).

If the result of the check indicates that the canister side pressure Pc is not significantly changed, it can be judged that the sealing valve 28 did not properly open in compliance with the valve open instruction. In this instance, the routine concludes that the sealing valve 28 is stuck closed (step 300), turns OFF the KEY OFF monitor operation flag (step 302), and then terminates the abnormality detection process.

If, on the other hand, it is found in step 298 that the canister side pressure Pc is significantly changed, it can be judged that the sealing valve 28 properly opened in compliance with the valve open instruction. In this instance, the routine concludes that there is no abnormality resulting from a close failure of the sealing valve 28 (step 304), and then determines whether the fuel tank 10 needs to be checked for leaks (step 306).

If the airtightness of the fuel tank 10 is verified by the hermetic pressure check that is conducted at an early stage of the abnormality detection process, it is concluded in step 304 that the fuel tank need not be checked for leaks. In this instance, the routine executes processing step 302 in order to terminate the abnormality detection process. If, on the other hand, the airtightness of the fuel tank 110 is not verified, the routine shown in FIG. 12 starts to conduct a leak check on the space containing the fuel tank 10.

As described above, the routine shown in FIG. 16 can conduct a close failure diagnostic check on the sealing valve 28 by making effective use of the negative pressure that is stored in the space on the side toward the canister 26 if a proper differential pressure is generated between both sides of the sealing valve 28 at the end of an open failure diagnostic check on the sealing valve 28. If, on the other hand, a proper differential pressure is not generated between both sides of the sealing valve 28 at the end of the open failure diagnostic check on the sealing valve 28, the routine forcibly generates a differential pressure between both sides of the sealing valve 28 to conduct a close failure diagnostic check on the sealing valve 28. As a result, the evaporated fuel treatment device according to the present embodiment can conduct an open failure diagnostic check and close failure diagnostic check on the sealing valve 28 efficiently and with constantly high accuracy.

If an appropriate differential pressure is not generated across the sealing valve 28 at the end of the open failure diagnostic check on the sealing valve 28 (at time t5), the third embodiment, which has been described above, restores the canister side pressure Pc to the atmospheric pressure level and then reintroduces a negative pressure to properly render the canister side pressure Pc negative. This sequence is followed on the presumption that an increased degree of control accuracy is not required for the open/close timing of the sealing valve 28. However, if the open/close timing of the sealing valve 28 can be controlled with high accuracy, the sequence described below may be followed instead of the above sequence to properly render the canister side pressure Pc negative.

FIGS. 17A through 17E are timing diagrams illustrating a sequence that may be followed in situations where the open/close timing of the sealing valve 28 can be controlled with high accuracy. This timing diagram is similar to the one shown in FIGS. 15A through 15E except that the canister side pressure Pc is properly rendered negative by the atmosphere introduction process after time t5.

Figure 18:
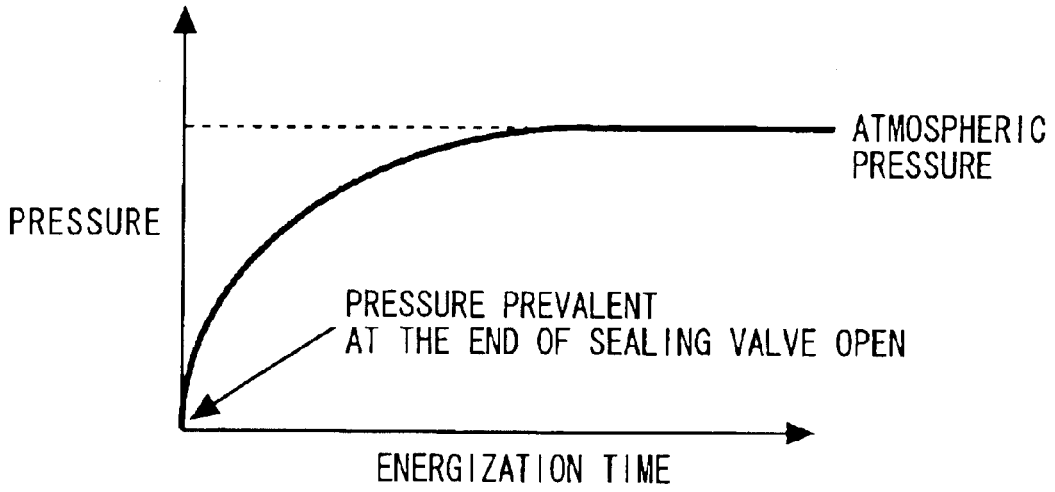
FIG. 18 shows a relationship between time period in which the sealing valve is in an open state (energized state) and pressure change arises within a canister side space.

When the sealing valve 28 properly opens after termination of the open failure diagnostic check on the sealing valve 28, the change in the canister side pressure Pc can be illustrated as shown in FIG. 18. This indicates that, if the time for energizing the sealing valve 28 is accurately controlled, the canister side pressure Pc can be properly rendered negative at a stage when such energization is stopped.

If, as indicated in FIGS. 17A through 17E, the evaporated fuel treatment device of the present embodiment terminates the atmosphere introduction process when the canister side pressure Pc is properly rendered negative, the negative pressure introduced during an open failure diagnostic check can be effectively used to conduct a close diagnostic check on the sealing valve 28 without performing the negative pressure reintroduction process. Therefore, the indicated sequence provides higher efficiency in close failure judgment and reduces the time required for abnormality detection process execution.

When the sequence indicated in FIGS. 17A through 17E is followed to conduct a close diagnostic check on the sealing valve 28, the time for atmosphere introduction termination (time T1), that is, the time for issuing a valve open instruction to the sealing valve 28 and placing the switching valve 80 in the negative pressure introduction state can be defined as the time at which a predetermined period of time elapses subsequently to the end of the open failure diagnostic check. Alternatively, this time may be defined as the time at which the canister side pressure Pc measured by the pump module pressure sensor 86 reaches a predetermined negative pressure level.

Although the third embodiment, which has been described above, assumes that the open failure diagnostic check on the sealing valve 28 is conducted according to the negative pressure method, the open failure diagnostic check on the sealing valve 28 may alternatively be conducted according to the positive pressure method. If such an alternative method is used, the same advantage can be obtained as provided by the third embodiment when the atmosphere introduction process (time t5 to time T1 in FIGS. 15A through 15E) is performed to reduce the canister side pressure Pc to the atmospheric pressure level and a positive pressure reintroduction process is executed instead of the negative pressure reintroduction process (time T1 to time T2).

The major benefits of the present invention described above are summarized as follows:

According to the first aspect of the present invention, it is possible to conduct a failure diagnostic check on the sealing valve in conjunction with a system leak check. In this instance, the differential pressure generated across the sealing valve for open failure diagnostic check purposes can be utilized to conduct a close failure diagnostic check. As a result, the present invention can conduct a failure diagnostic check on the sealing valve efficiently and accurately.

According to the second aspect of the present invention, it is possible to use the pressure remaining in a hermetically closed space containing the canister or in a hermetically closed space containing fuel tank at a time when a close failure diagnostic check on the sealing valve is terminated for the purpose of generating a differential pressure necessary for a system leak check. Therefore, the present invention can increase the efficiency of a system leak check in addition to provide increased efficiency in the open failure and close failure diagnostic checks on the sealing valve.

According to the third aspect of the present invention, it is possible to accurately determine whether an open failure has occurred in the sealing valve on the basis whether the pressure within a hermetically closed space containing the canister properly changes in accordance with the operation for generating the differential pressure. Further, the present invention can also generate a pressure different from the atmospheric pressure within a hermetically closed space on the side toward the canister at the time when an open failure diagnostic check terminates.

According to the fourth aspect of the present invention, it is possible to issue a valve open instruction to the sealing valve upon termination of an open failure diagnostic check. If, in this instance, a differential pressure is generated between both sides of the sealing valve and the sealing valve properly opens, a significant pressure change occurs in both the hermetically closed space containing the canister and the hermetically closed space containing the fuel tank. The present invention can check for a close failure in the sealing valve efficiently and with high accuracy by judging whether such a pressure change has occurred.

According to the fifth aspect of the present invention, it is possible to forcibly generate a differential pressure to conduct a close failure diagnostic check if the pressure generated within a hermetically closed space on the side toward the fuel tank is equivalent to the pressure within a hermetically closed space on the side toward the canister, that is, if no differential pressure is generated across the sealing valve at the time of an open failure diagnostic check. Therefore, the present invention can conduct an accurate close failure diagnostic check on the sealing valve even if the above unfavorable situation arises.

Further, the present invention is not limited to these embodiments, but variations and modifications may be made without departing from the scope of the present invention. The entire disclosure of Japanese Patent Application No. 2002-321658 filed on Nov. 5, 2002 including specification, claims, drawings and summary are incorporated herein by reference in its entirety.

What is claimed is:

1. An evaporated fuel treatment device for internal combustion engine that uses a canister to absorb evaporated fuel generated in a fuel tank for evaporated fuel treatment purposes, said device comprising:

a sealing valve for controlling the continuity between said fuel tank and said canister;

a purge control valve for controlling the continuity of a purge path for communication between said canister and the internal combustion engine;

a differential pressure generation means for producing a pressure differential between the inside and the outside of the canister;

a leak check means for activating said differential pressure generation means while said purge control valve is closed, and conducting a system leak check in accordance with a resulting pressure generated within a hermetically closed space containing said canister or within a hermetically closed space containing said fuel tank; and a sealing valve diagnostic means for conducting a failure diagnostic check on said sealing valve simultaneously with the execution of processing for said leak check;

wherein said sealing valve diagnostic means comprises an open failure diagnostic means for activating said differential pressure generation means while said purge control valve and said sealing valve are closed, and conducting an open failure diagnostic check on said sealing valve in accordance with a resulting pressure generated within a hermetically closed space containing said canister or within a hermetically closed space containing said fuel tank; and a close failure diagnostic means for conducting a close failure diagnostic check on said sealing valve in accordance with a differential pressure that is generated between both sides of said sealing valve upon said open failure diagnostic check.

2. The evaporated fuel treatment device for internal combustion engine according to claim 1, wherein said leak check means conducts said leak check by using a pressure remaining within a hermetically closed space containing said canister or within a hermetically closed space containing said fuel tank after said close failure diagnostic check.

3. The evaporated fuel treatment device for internal combustion engine according to claim 1, wherein said open failure diagnostic means determines an open failure of said sealing valve if the pressure within a hermetically closed space containing said canister reaches a prescribed steady state during activity of said differential pressure generation means without attaining a sealing valve open failure judgment value or without deviating more than a predetermined judgment value from the pressure within a hermetically closed space containing said fuel tank.

4. The evaporated fuel treatment device for internal combustion engine according to claim 1, wherein said close failure diagnostic means comprises a sealing valve open instruction means for issuing a valve open instruction to said sealing valve when a differential pressure is generated between both sides of said sealing valve after said open failure diagnostic check; and a close failure judgment means for determining whether a close failure has occurred in said sealing valve by checking whether the pressure within a hermetically closed space containing said canister or within a hermetically closed space containing said fuel tank varies upon issuance of said valve open instruction.

5. The evaporated fuel treatment device for internal combustion engine according to claim 1 wherein said close failure diagnostic means comprises a differential pressure adequacy judgment means for determining whether the differential pressure generated between both sides of said sealing valve is adequate for a close failure diagnostic check on said sealing valve; and an adequate differential pressure generation means for varying, if an inadequate differential pressure is generated between both sides of said sealing valve, the pressure within a hermetically closed space containing said canister until an adequate differential pressure is obtained.

* * * * *